US011540577B2

(12) United States Patent
Vito

(10) Patent No.: US 11,540,577 B2
(45) **Date of Patent: *Jan. 3, 2023**

(54) HELMET SYSTEM

(71) Applicant: Matscitechno Licensing Company, Kennett Square, PA (US)

(72) Inventor: Robert A. Vito, Kennett Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 235 days.

This patent is subject to a terminal disclaimer.

(21) Appl. No.: 16/817,223

(22) Filed: Mar. 12, 2020

(65) Prior Publication Data

US 2021/0282488 A1 Sep. 16, 2021

(51) Int. Cl.
*A42B 3/06* (2006.01)

(52) U.S. Cl.
CPC ..... *A42B 3/062* (2013.01)

(58) Field of Classification Search
CPC .... A42B 3/062–064; A42B 3/08; A63B 71/10
See application file for complete search history.

(56) References Cited

U.S. PATENT DOCUMENTS

| | | | |
|---|---|---|---|
| 1,522,952 | A | 1/1925 | Goldsmith |
| 1,602,727 | A | 10/1926 | Turner |
| 2,250,725 | A | 7/1941 | Riddell |
| 2,420,522 | A | 5/1947 | Daly |
| 2,455,797 | A | 12/1948 | Myers et al. |
| 2,532,442 | A | 12/1950 | Daly |
| 2,610,332 | A | 9/1952 | Field |
| 2,753,561 | A | 7/1956 | Mauro |
| 2,969,547 | A | 1/1961 | Dye |
| 3,067,427 | A | 12/1962 | McClintock |
| 3,153,792 | A | 10/1964 | Marietta |

(Continued)

FOREIGN PATENT DOCUMENTS

| | | | |
|---|---|---|---|
| CH | 689008 | A5 | 7/1998 |
| CN | 104244755 | A | 12/2014 |

(Continued)

OTHER PUBLICATIONS

Non Final Office Action for U.S. Appl. No. 16/774,494, dated Sep. 1, 2021, 101 pages.

(Continued)

*Primary Examiner* — Katherine M Moran
(74) *Attorney, Agent, or Firm* — RatnerPrestia

(57) ABSTRACT

A helmet system having an outer helmet, an inner helmet, and one or more orbital connectors joining the outer helmet to the inner helmet. Each orbital connector may include: a slip disc housing, a slip disc, and a post. The slip disc housing is mounted on one of the outer helmet and the inner helmet and has a first face and an opening through the first face. The slip disc has a second face abutting the first face, and the second face is movable in sliding contact with the first face relative to a spherical center. The post extends through the opening and mounts the slip disc to the other of the outer helmet and the inner helmet. The post is dimensioned to move within the opening to allow the second face to move tangentially to the spherical center in sliding contact with the first face.

18 Claims, 15 Drawing Sheets

(56) References Cited

U.S. PATENT DOCUMENTS

| | | | |
|---|---|---|---|
| 3,166,761 | A | 1/1965 | Strohm |
| 3,197,784 | A | 8/1965 | Carlisle |
| 3,208,080 | A | 9/1965 | Hirsch |
| 3,290,693 | A | 12/1966 | Wolfe |
| 3,315,273 | A | 4/1967 | Bullard |
| 3,500,473 | A | 3/1970 | Marchello |
| 3,529,306 | A | 9/1970 | Thorne |
| 3,568,210 | A | 3/1971 | Marietta |
| 3,577,562 | A | 5/1971 | Holt |
| 3,582,990 | A | 6/1971 | Frieder |
| 3,609,764 | A | 10/1971 | Morgan |
| 3,665,514 | A | 5/1972 | Durand |
| 3,783,450 | A | 1/1974 | O'Connor |
| 3,845,389 | A | 10/1974 | Phillips et al. |
| 3,897,596 | A | 8/1975 | Aileo et al. |
| 3,906,546 | A | 9/1975 | Gooding |
| 3,994,020 | A | 11/1976 | Villari |
| 3,994,021 | A | 11/1976 | Villari et al. |
| 3,994,023 | A | 11/1976 | Aileo et al. |
| 4,233,687 | A | 11/1980 | Lancellotti |
| 4,282,610 | A | 8/1981 | Steigerwald et al. |
| D267,287 | S | 12/1982 | Gooding |
| 4,375,108 | A | 3/1983 | Gooding |
| 4,404,690 | A | 9/1983 | Farquharson |
| 4,432,099 | A | 2/1984 | Grick et al. |
| 4,484,364 | A | 11/1984 | Mitchell et al. |
| 4,596,056 | A | 6/1986 | Grick |
| 4,627,114 | A | 12/1986 | Mitchell |
| 4,729,132 | A | 3/1988 | Fierro |
| 4,821,341 | A | 4/1989 | Baptiste |
| 4,833,735 | A | 5/1989 | Long |
| 4,856,119 | A | 8/1989 | Häberle |
| 4,903,381 | A | 2/1990 | Fohl |
| 4,996,724 | A | 3/1991 | Dextrase |
| 5,012,533 | A | 5/1991 | Raffler |
| 5,014,365 | A | 5/1991 | Schulz |
| 5,035,009 | A | 7/1991 | Wingo et al. |
| 5,088,126 | A | 2/1992 | Mathis |
| 5,088,129 | A | 2/1992 | Kamata |
| 5,119,505 | A | 6/1992 | Tisseront et al. |
| 5,119,514 | A | 6/1992 | Woehl |
| 5,173,970 | A | 12/1992 | Shifrin |
| 5,177,815 | A | 1/1993 | Andujar |
| 5,226,180 | A | 7/1993 | Leach |
| 5,249,347 | A | 10/1993 | Martinitz |
| 5,269,025 | A | 12/1993 | Broersma |
| 5,269,026 | A | 12/1993 | McManus |
| 5,271,103 | A | 12/1993 | Darnell |
| 5,289,591 | A | 3/1994 | Anderson |
| 5,298,208 | A | 3/1994 | Sibley et al. |
| 5,337,420 | A | 8/1994 | Haysom et al. |
| D364,496 | S | 11/1995 | Lejuez |
| 5,515,546 | A | 5/1996 | Shifrin |
| 5,517,691 | A | 5/1996 | Blake |
| 5,519,895 | A | 5/1996 | Barnes, Jr. |
| 5,587,239 | A | 12/1996 | Ueba et al. |
| 5,598,588 | A | 2/1997 | Lee |
| 5,603,117 | A | 2/1997 | Hudner, Jr. et al. |
| 5,625,901 | A | 5/1997 | Healy |
| 5,661,854 | A | 9/1997 | March |
| 5,666,670 | A | 9/1997 | Ryan et al. |
| 5,687,426 | A | 11/1997 | Sperber |
| 5,713,082 | A | 2/1998 | Bassette et al. |
| 5,752,298 | A | 5/1998 | Howell |
| 5,815,847 | A | 10/1998 | Holden |
| 5,887,289 | A | 3/1999 | Theoret |
| D410,768 | S | 6/1999 | Hirsh |
| 5,913,412 | A | 6/1999 | Huber et al. |
| 5,915,537 | A | 6/1999 | Dallas et al. |
| 5,915,538 | A | 6/1999 | Basson et al. |
| 5,987,649 | A | 11/1999 | Robertson |
| 5,996,126 | A | 12/1999 | Barthold et al. |
| 6,073,271 | A | 6/2000 | Alexander et al. |
| 6,073,272 | A | 6/2000 | Ball |
| 6,081,929 | A | 7/2000 | Rothrock et al. |
| 6,093,468 | A | 7/2000 | Toms et al. |
| 6,094,750 | A | 8/2000 | Lee |
| 6,108,824 | A | 8/2000 | Fournier et al. |
| D431,329 | S | 9/2000 | Chen |
| 6,138,283 | A | 10/2000 | Kress |
| 6,154,889 | A | 12/2000 | Moore et al. |
| 6,219,850 | B1 | 4/2001 | Halstead et al. |
| 6,240,571 | B1 | 6/2001 | Infusino |
| 6,256,798 | B1 | 7/2001 | Egolf et al. |
| 6,256,799 | B1 | 7/2001 | McGlasson et al. |
| 6,282,724 | B1 | 9/2001 | Abraham et al. |
| 6,298,497 | B1 | 10/2001 | Chartrand |
| 6,301,719 | B1 | 10/2001 | Goodhand et al. |
| 6,324,700 | B1 | 12/2001 | McDougall |
| 6,343,385 | B1 | 2/2002 | Katz |
| 6,349,416 | B1 | 2/2002 | Lampe et al. |
| 6,360,376 | B1 | 3/2002 | Carrington |
| 6,367,090 | B1 | 4/2002 | Im |
| 6,370,697 | B1 | 4/2002 | Held |
| 6,374,423 | B1 | 4/2002 | Anderson et al. |
| 6,381,759 | B1 | 5/2002 | Katz |
| 6,385,780 | B1 | 5/2002 | Racine |
| 6,389,607 | B1 | 5/2002 | Wood |
| 6,418,564 | B1 | 7/2002 | Sheridan |
| 6,425,143 | B1 | 7/2002 | Benedict et al. |
| 6,434,755 | B1 | 8/2002 | Halstead et al. |
| 6,442,765 | B1 | 9/2002 | Fallon et al. |
| 6,453,476 | B1 | 9/2002 | Moore |
| 6,457,210 | B1 | 10/2002 | Shirai et al. |
| 6,499,139 | B1 | 12/2002 | Brown et al. |
| 6,519,781 | B1 | 2/2003 | Berns |
| 6,550,071 | B2 | 4/2003 | Garneau |
| D479,020 | S | 8/2003 | Heinrich |
| 6,647,556 | B2 | 11/2003 | Grepper et al. |
| 6,694,529 | B1 | 2/2004 | Chiu |
| 6,751,808 | B2 | 6/2004 | Puchalski |
| 6,760,927 | B2 | 7/2004 | Guay |
| 6,883,181 | B2 | 4/2005 | Long |
| 6,961,963 | B2 | 11/2005 | Rosie |
| 6,996,856 | B2 | 2/2006 | Puchalski |
| 7,010,814 | B2 | 3/2006 | Benzinger |
| 7,096,512 | B2 | 8/2006 | Blair |
| 7,159,249 | B2 | 1/2007 | Dennis et al. |
| 7,246,383 | B2 | 7/2007 | Musal |
| D556,951 | S | 12/2007 | Gath |
| D577,866 | S | 9/2008 | Frye et al. |
| D582,607 | S | 12/2008 | Ferrara et al. |
| 7,475,434 | B2 | 1/2009 | Ambuske et al. |
| D592,380 | S | 5/2009 | McLaughlin |
| D604,461 | S | 11/2009 | Goldman et al. |
| D612,545 | S | 3/2010 | Pliszka |
| 7,673,350 | B2 | 3/2010 | Mazzoccoli et al. |
| D617,503 | S | 6/2010 | Szalkowski et al. |
| 7,765,622 | B2 | 8/2010 | Wiles |
| D637,356 | S | 5/2011 | Green et al. |
| 7,950,073 | B2 | 5/2011 | Ferrara |
| D640,422 | S | 6/2011 | Green et al. |
| 7,958,570 | B1 | 6/2011 | Mooney |
| 7,958,573 | B2 | 6/2011 | Lewis et al. |
| 8,001,622 | B1 | 8/2011 | Culley et al. |
| 8,001,624 | B1 | 8/2011 | Leedom |
| 8,046,845 | B1 | 11/2011 | Garcia et al. |
| 8,087,099 | B2 | 1/2012 | Sawabe |
| 8,095,995 | B2 | 1/2012 | Alexander et al. |
| 8,146,178 | B2 | 4/2012 | Maddux et al. |
| 8,156,569 | B2 | 4/2012 | Cripton et al. |
| 8,156,574 | B2 | 4/2012 | Stokes et al. |
| D660,519 | S | 5/2012 | Laloy |
| 8,196,226 | B1 | 6/2012 | Schuh |
| 8,205,272 | B2 | 6/2012 | Green et al. |
| D663,076 | S | 7/2012 | Parsons et al. |
| D663,901 | S | 7/2012 | Vito et al. |
| D666,779 | S | 9/2012 | Harris et al. |
| D667,592 | S | 9/2012 | Vito et al. |
| D670,868 | S | 11/2012 | Harris |
| D670,869 | S | 11/2012 | Harris |
| D670,870 | S | 11/2012 | Harris |
| D671,270 | S | 11/2012 | Ho |
| 8,353,066 | B2 | 1/2013 | Rogers et al. |

(56) References Cited

U.S. PATENT DOCUMENTS

| | | | |
|---|---|---|---|
| D687,215 | S | 8/2013 | Padgett et al. |
| 8,534,279 | B2 | 9/2013 | Brace et al. |
| 8,544,118 | B2 | 10/2013 | Brine, III et al. |
| 8,572,767 | B2 | 11/2013 | Bryant et al. |
| D695,966 | S | 12/2013 | Futterer |
| D697,267 | S | 1/2014 | Benvegnu' |
| 8,640,267 | B1 | 2/2014 | Cohen |
| D701,348 | S | 3/2014 | Thurgood et al. |
| 8,739,316 | B1 | 6/2014 | Norton |
| 8,776,273 | B2 | 7/2014 | Krause |
| 8,789,212 | B2 | 7/2014 | Cleva |
| 8,850,622 | B2 | 10/2014 | Finiel et al. |
| D724,294 | S | 3/2015 | Vito |
| 8,978,167 | B2 | 3/2015 | Blair |
| 9,131,744 | B2 | 9/2015 | Erb et al. |
| 9,155,924 | B1 | 10/2015 | Grove et al. |
| D749,272 | S | 2/2016 | Vito |
| 9,277,781 | B2 | 3/2016 | Hardy |
| D754,930 | S | 4/2016 | Vito et al. |
| 9,307,800 | B2 | 4/2016 | Andrews et al. |
| 9,332,798 | B2 | 5/2016 | Gafforio et al. |
| 9,364,039 | B2 | 6/2016 | Pusateri |
| 9,414,636 | B2 | 8/2016 | Pietrzak |
| D769,541 | S | 10/2016 | Meier |
| 9,474,316 | B2 | 10/2016 | Berry |
| 9,474,318 | B2 | 10/2016 | Wesson et al. |
| 9,504,288 | B2 | 11/2016 | Ratti et al. |
| 9,526,291 | B2 | 12/2016 | Beauchamp et al. |
| 9,642,409 | B2 | 5/2017 | Roesler |
| 9,861,153 | B2 | 1/2018 | Finisdore |
| D812,313 | S | 3/2018 | Williams |
| 9,907,347 | B2 | 3/2018 | Allen |
| 10,076,149 | B2 | 9/2018 | Ross et al. |
| 10,092,056 | B2 | 10/2018 | Durocher |
| 10,357,077 | B2 | 7/2019 | Pietrzak |
| 10,362,829 | B2 | 7/2019 | Lowe |
| 10,433,610 | B2 | 10/2019 | Lee |
| D867,672 | S | 11/2019 | Votel et al. |
| 10,709,190 | B2 | 7/2020 | Brachos et al. |
| 10,779,599 | B2 | 9/2020 | Votel et al. |
| 10,791,789 | B2 | 10/2020 | Creak et al. |
| D903,947 | S | 12/2020 | Pietruk |
| 10,905,187 | B1 | 2/2021 | Bochner et al. |
| 11,253,021 | B2 | 2/2022 | Saijo |
| 2002/0000004 | A1 | 1/2002 | Wise et al. |
| 2002/0002730 | A1 | 1/2002 | Dennis et al. |
| 2002/0007508 | A1 | 1/2002 | Grepper et al. |
| 2002/0023290 | A1 | 2/2002 | Watters et al. |
| 2002/0035748 | A1 | 3/2002 | Racine |
| 2002/0114959 | A1 | 8/2002 | Kang et al. |
| 2002/0152542 | A1 | 10/2002 | Dennis et al. |
| 2003/0070209 | A1 | 4/2003 | Falone et al. |
| 2003/0167558 | A1 | 9/2003 | Broersma |
| 2004/0034903 | A1 | 2/2004 | Blair |
| 2004/0040073 | A1 | 3/2004 | Morrow et al. |
| 2004/0107482 | A1 | 6/2004 | Picotte |
| 2004/0172739 | A1 | 9/2004 | Racine |
| 2004/0181854 | A1 | 9/2004 | Primrose |
| 2004/0226077 | A1 | 11/2004 | Toth |
| 2005/0034223 | A1 | 2/2005 | Durocher |
| 2005/0060908 | A1 | 3/2005 | Vito et al. |
| 2005/0166302 | A1 | 8/2005 | Dennis |
| 2005/0251899 | A1 | 11/2005 | Dennis et al. |
| 2005/0257312 | A1 | 11/2005 | Puchalski |
| 2005/0268383 | A1 | 12/2005 | Harris |
| 2006/0010579 | A1 | 1/2006 | Wiles |
| 2006/0059605 | A1 | 3/2006 | Ferrara |
| 2006/0096011 | A1 | 5/2006 | Dennis et al. |
| 2006/0143807 | A1 | 7/2006 | Udelhofen et al. |
| 2006/0168712 | A1 | 8/2006 | Mazzoccoli et al. |
| 2006/0260026 | A1 | 11/2006 | Doria et al. |
| 2007/0130670 | A1 | 6/2007 | Henf |
| 2007/0130673 | A1 | 6/2007 | Wasserkrug et al. |
| 2007/0157370 | A1 | 7/2007 | Joubert Des Ouches |
| 2007/0163031 | A1 | 7/2007 | Lewis et al. |
| 2008/0092279 | A1 | 4/2008 | Chiang |
| 2009/0083890 | A1 | 4/2009 | Dempsey et al. |
| 2009/0106882 | A1 | 4/2009 | Nimmons et al. |
| 2009/0158506 | A1 | 6/2009 | Thompson et al. |
| 2009/0222964 | A1 | 9/2009 | Wiles |
| 2009/0222976 | A1 | 9/2009 | Loury et al. |
| 2010/0258988 | A1 | 10/2010 | Darnell et al. |
| 2010/0306904 | A1 | 12/2010 | Neid |
| 2011/0047679 | A1 | 3/2011 | Rogers et al. |
| 2011/0047680 | A1 | 3/2011 | Hoying et al. |
| 2011/0113533 | A1 | 5/2011 | Guillen |
| 2011/0302700 | A1 | 12/2011 | Vito et al. |
| 2011/0307997 | A1 | 12/2011 | Blair |
| 2012/0000011 | A1 | 1/2012 | Grewall |
| 2012/0036620 | A1 | 2/2012 | Harris |
| 2012/0047635 | A1 | 3/2012 | Finiel et al. |
| 2012/0186003 | A1 | 7/2012 | Heger et al. |
| 2012/0210482 | A1 | 8/2012 | Polstein et al. |
| 2012/0317705 | A1 | 12/2012 | Lindsay |
| 2013/0000017 | A1 | 1/2013 | Szalkowski et al. |
| 2013/0340146 | A1 | 12/2013 | Dekker et al. |
| 2014/0007322 | A1 | 1/2014 | Marz et al. |
| 2014/0020158 | A1 | 1/2014 | Parsons et al. |
| 2014/0097052 | A1 | 4/2014 | Reynolds et al. |
| 2014/0189941 | A1 | 7/2014 | Domencio |
| 2014/0201889 | A1 | 7/2014 | Pietrzak et al. |
| 2014/0223644 | A1 | 8/2014 | Bologna et al. |
| 2014/0245524 | A1 | 9/2014 | Stephens |
| 2014/0317835 | A1 | 10/2014 | Mejia, Jr. |
| 2014/0325745 | A1 | 11/2014 | Erb et al. |
| 2014/0338104 | A1 | 11/2014 | Vito et al. |
| 2015/0000015 | A1 | 1/2015 | Beauchamp et al. |
| 2015/0013050 | A1 | 1/2015 | Floyd, Jr. et al. |
| 2015/0020294 | A1 | 1/2015 | Kirshon |
| 2015/0089726 | A1 | 4/2015 | Long |
| 2015/0096113 | A1 | 4/2015 | Garneau et al. |
| 2015/0245621 | A1 | 9/2015 | Stewart |
| 2015/0264993 | A1 | 9/2015 | Vito et al. |
| 2015/0272257 | A1 | 10/2015 | Pritz et al. |
| 2015/0282550 | A1 | 10/2015 | Musal |
| 2015/0305423 | A1 | 10/2015 | Pusateri |
| 2015/0320134 | A1 | 11/2015 | Stolker |
| 2015/0359285 | A1 | 12/2015 | Rennaker, II et al. |
| 2016/0021965 | A1 | 1/2016 | Mayerovitch |
| 2017/0105461 | A1 | 4/2017 | Hancock et al. |
| 2017/0224042 | A1 | 8/2017 | Abraham |
| 2017/0273388 | A1 | 9/2017 | Vito et al. |
| 2017/0280811 | A1 | 10/2017 | Finisdore |
| 2017/0340045 | A1 | 11/2017 | Pickett |
| 2018/0049508 | A1 | 2/2018 | Terry |
| 2018/0325203 | A1 | 11/2018 | Cotterman |
| 2019/0090573 | A1 | 3/2019 | Votel et al. |
| 2020/0029643 | A1 | 1/2020 | Salvetti et al. |
| 2020/0121016 | A1 | 4/2020 | Skemp et al. |
| 2021/0282489 | A1* | 9/2021 | Vito ..... A42B 3/062 |
| 2021/0323623 | A1 | 10/2021 | Anderson et al. |

FOREIGN PATENT DOCUMENTS

| | | | |
|---|---|---|---|
| DE | 508419 | C | 9/1930 |
| DE | 2210205 | B1 | 3/1973 |
| DE | 8804821 | U1 | 6/1988 |
| DE | 29605144 | U1 | 5/1996 |
| DE | 202004012916 | U | 12/2004 |
| DE | 102006058782 | A1 | 6/2008 |
| EP | 0217996 | A1 | 4/1987 |
| EP | 0623292 | A1 | 11/1994 |
| EP | 1136007 | A2 | 9/2001 |
| GB | 2342845 | A | 4/2000 |
| GB | 2453775 | A | 10/2007 |
| JP | 2001073218 | A | 3/2001 |
| JP | 3154479 | U | 10/2009 |
| JP | 2017150126 | A | 8/2017 |
| KR | 200456037 | Y1 | 10/2011 |
| KR | 20130025534 | A | 3/2013 |
| KR | 20130104004 | A | 9/2013 |
| WO | 9846095 | A2 | 10/1998 |
| WO | 0035307 | A1 | 6/2000 |
| WO | 03005843 | A1 | 1/2003 |

(56) References Cited

FOREIGN PATENT DOCUMENTS

| | | | |
|---|---|---|---|
| WO | 2004016122 | A1 | 2/2004 |
| WO | 2005027671 | A1 | 3/2005 |
| WO | 2012074400 | A1 | 6/2012 |
| WO | 2013068708 | A1 | 5/2013 |
| WO | 2016112987 | A1 | 7/2016 |
| WO | 2016132227 | | 8/2016 |
| WO | 2017006078 | A1 | 1/2017 |
| WO | 2016196724 | A1 | 12/2018 |
| WO | 2021224755 | A1 | 11/2021 |

OTHER PUBLICATIONS

Final Office Action for U.S. Appl. No. 15/923,117, dated Jan. 25, 2021, 54 pages.
ABS vs Polycarbonate: Which Helmet Shell Material is Better? Helmets [online]. Things That Fold, retrieved from the internet at https://thingsthatfold.com/abs-vs-polycarbonate, 2020, 14 pages.
Notice of Allowance for U.S. Appl. No. 14/493,869, dated Jan. 11, 2021, 23 pages.
Notice of Allowance for U.S. Appl. No. 14/488,650, dated Oct. 15, 2021, 34 pages.
Non Final Office Action for U.S. Appl. No. 16/210,271, dated May 12, 2021, 114 pages.
Non Final Office Action for U.S. Appl. No. 14/493,869, dated Apr. 11, 2017, 45 pages.
European Communication for European Application No. 13 837 366.7, dated Mar. 17, 2017, 4 pages.
Notice of Allowance for U.S. Appl. No. 29/448,876, dated May 27, 2014, 9 pages.
Notice of Allowance for U.S. Appl. No. 29/448,874, dated Sep. 16, 2014, 13 pages.
Notice of Allowance for U.S. Appl. No. 29/449,385, dated Feb. 13, 2015, 16 pages.
Notice of Allowance for U.S. Appl. No. 29/449,389, dated Feb. 17, 2015, 15 pages.
Non-Final Office Action for U.S. Appl. No. 13/803,539, dated Feb. 20, 2015, 21 pages.
International Search Report and Written Opinion for International Application No. PCT/US2014/037764, dated Sep. 26, 2014, 8 pages.
International Search Report and Written Opinion for International Application No. PCT/US2013/058399, dated Dec. 30, 2013, 11 pages.
International Search Report and Written Opinion for International Application No. PCT/US2013/058396, dated Dec. 19, 2013, 11 pages.
International Preliminary Report on Patentability for International Application No. PCT/US2013/058396, dated Mar. 17, 2015, 9 pages.
International Preliminary Report on Patentability for International Application No. PCT/US2013/058399, dated Mar. 17, 2015, 9 pages.
International Search Report for International Application No. PCT/US2015/014352, dated May 29, 2015, 12 pages.
Non-Final Office Action for U.S. Appl. No. 14/275,046, dated Jul. 20, 2015, 16 pages.
Non Final Office Action for U.S. Appl. No. 15/898,814, dated Jun. 25, 2020, 81 pages.
Extended European Search Report for European Application No. 19213884.0, dated May 13, 2020, 9 pages.
Non Final Office Action for U.S. Appl. No. 14/493,869, dated Apr. 1, 2020, 36 pages.
Chinese Office Action for Chinese Application No. 201680039517.9, dated Feb. 25, 2020, 26 pages.
International Preliminary Report on Patentability for International Application No. PCT/US2018/040741, dated Jan. 7, 2020, 7 pages.
International Search Report and Written Opinion for International Application No. PCT/US2019/019507, dated Jun. 12, 2019, 10 pages.
Non Final Office Action for U.S. Appl. No. 15/644,145, dated Dec. 11, 2019, 46 pages.
Brookman, "PVC Thermoplastic Elastomers", Journal of Vinyl Technology, vol. 10, Issue 1, 1988, pp. 33-36 Abstract Only.
Non Final Office Action for U.S. Appl. No. 15/488,650, dated Oct. 28, 2019, 52 pages.
European Communication for European Application No. 16 804 386.7, dated Nov. 7, 2019, 4 pages.
International Preliminary Report on Patentability for International Application No. PCT/US2018/027729, dated Oct. 22, 2019, 9 pages.
Final Office Action for U.S. Appl. No. 14/493,869, dated Aug. 22, 2019, 31 pages.
Final Office Action for U.S. Appl. No. 13/803,539, dated Feb. 25, 2019, 26 pages.
Final Office Action for U.S. Appl. No. 14/493,869, dated Feb. 8, 2019, 34 pages.
Extended European Search Report for European Application No. 16 804 386.7, dated Dec. 19, 2018, 7 pages.
International Search Report and Written Opinion for International Application No. PCT/US2018/040741, dated Mar. 7, 2019, 9 pages.
Non-Final Office Action for U.S. Appl. No. 13/803,539, dated Jan. 24, 2018, 14 pages.
European Communication for European Application No. 13 841 097.2, dated Nov. 22, 2017, 4 pages.
Final Office Action for U.S. Appl. No. 14/493,869, dated Dec. 27, 2017, 37 pages.
International Preliminary Report on Patentability for International Application No. PCT/US2016/035407, dated Dec. 5, 2017, 14 pages.
European Communication for European Application No. 13 837 366.7, dated Feb. 12, 2018, 3 pages.
International Search Report and Written Opinion for International Application No. PCT/US2018/027729, dated Aug. 3, 2018, 13 pages.
Notice of Allowance for U.S. Appl. No. 14/023,945, dated Aug. 9, 2018, 27 pages.
European Communication for European Application No. 13 837 348.5, dated Jun. 20, 2017, 5 pages.
Non-Final Office Action for U.S. Appl. No. 13/740,443, dated Sep. 21, 2017, 53 pages.
Mexican Office Action for Mexican Application No. MX/a/2015/003126, dated Sep. 4, 2017, 4 pages.
Taiwanese Office Action for Taiwanese Application No. 103117352, dated Jul. 26, 2017, 6 pages.
Final Office Action for U.S. Appl. No. 14/023,945, dated Jul. 7, 2017, 42 pages.
International Preliminary Report on Patentability for International Application No. PCT/US2013/060327, dated Mar. 31, 2015, 10 pages.
International Search Report and Written Opinion for International Application No. PCT/US2013/060327, dated Dec. 23, 2013, 12 pages.
Final Office Action for U.S. Appl. No. 14/275,046, dated Sep. 24, 2015, 15 pages.
Carhartt—Mens Workflex Ear Flap Cap, http://www.amazon.com/carhartt-mens-workflex-ear-flap/dp/B00A51XG28, 1 page.
Mexican Office Action for Mexican Application No. MX/f/2014/002555, dated Oct. 8, 2015, 4 pages.
Notice of Allowance for U.S. Appl. No. 29/537,185, dated Nov. 12, 2015, 10 pages.
Notice of Allowance for U.S. Appl. No. 29/482,916, dated Sep. 25, 2015, 9 pages.
Final Office Action for U.S. Appl. No. 13/803,539, dated Aug. 18, 2015, 21 pages.
Non-Final Office Action for U.S. Appl. No. 13/740,443, dated Dec. 17, 2015, 41 pages.
Notice of Allowance for U.S. Appl. No. 29/537,184, dated Dec. 9, 2015, 13 pages.
International Preliminary Report on Patentability for International Application No. PCT/US2014/037764, dated Nov. 17, 2015, 6 pages.

(56) References Cited

OTHER PUBLICATIONS

Non-Final Office Action for U.S. Appl. No. 13/803,539, dated Mar. 10, 2016, 18 pages.
Extended European Search Report for European Application No. 13 837 348.5, dated Apr. 22, 2016, 6 pages.
Extended European Search Report for European Application No. 13 837 366.7, dated Apr. 28, 2016, 6 pages.
Final Office Action for U.S. Appl. No. 13/740,443, dated Jul. 26, 2016, 19 pages.
International Preliminary Report on Patentability with Written Opinion for PCT/US2015/014352, dated Aug. 23, 2016, 10 pages.
International Search Report and Written Opinion for International Application No. PCT/US2016/035407, dated Sep. 19, 2016, 16 pages.
Non-Final Office Action for U.S. Appl. No. 14/023,945, dated Oct. 7, 2016, 39 pages.
Final Office Action for U.S. Appl. No. 13/803,539, dated Dec. 15, 2016, 16 pages.
Extended European Search Report for European Application No. 14 798 462.9, dated Dec. 19, 2016, 7 pages. 2018.
European Communication for European Application No. 14 798 462.9, dated Jan. 9, 2017, 1 page.
Extended European Search Report for European Application No. 13 841 097.2, dated Feb. 8, 2017, 13 pages.
International Search Report and Written Opinion for International Application No. PCT/US2021/021807, dated Jun. 24, 2021, 9 pages.
Non Final Office Action for U.S. Appl. No. 16/861,792, dated Apr. 12, 2022, 87 pages.
Final Office Action for U.S. Appl. No. 15/898,814, dated Mar. 12, 2021, 49 pages.
Extended European Search Report for European Application No. 18787617.2, dated Dec. 10, 2020, 6 pages.
Non Final Office Action for U.S. Appl. No. 15/644,145, dated Nov. 26, 2021, 34 pages.
Non Final Office Action for U.S. Appl. No. 16/210,271, dated Nov. 24, 2021, 33 pages.
Non Final Office Action for U.S. Appl. No. 15/898,814, dated Dec. 2, 2021, 31 pages.
Final Office Action for U.S. Appl. No. 16/774,494, dated Mar. 10, 2022, 29 pages.
Final Office Action for U.S. Appl. No. 16/210,271, dated Jun. 10, 2022, 28 pages.
Final Office Action for U.S. Appl. No. 15/644,145, dated Jun. 23, 2022, 23 pages.
Final Office Action for U.S. Appl. No. 15/898,814, dated Jul. 1, 2022, 27 pages.
Non Final Office Action for U.S. Appl. No. 17/100,267, dated Oct. 17, 2022, 99 pages.

* cited by examiner

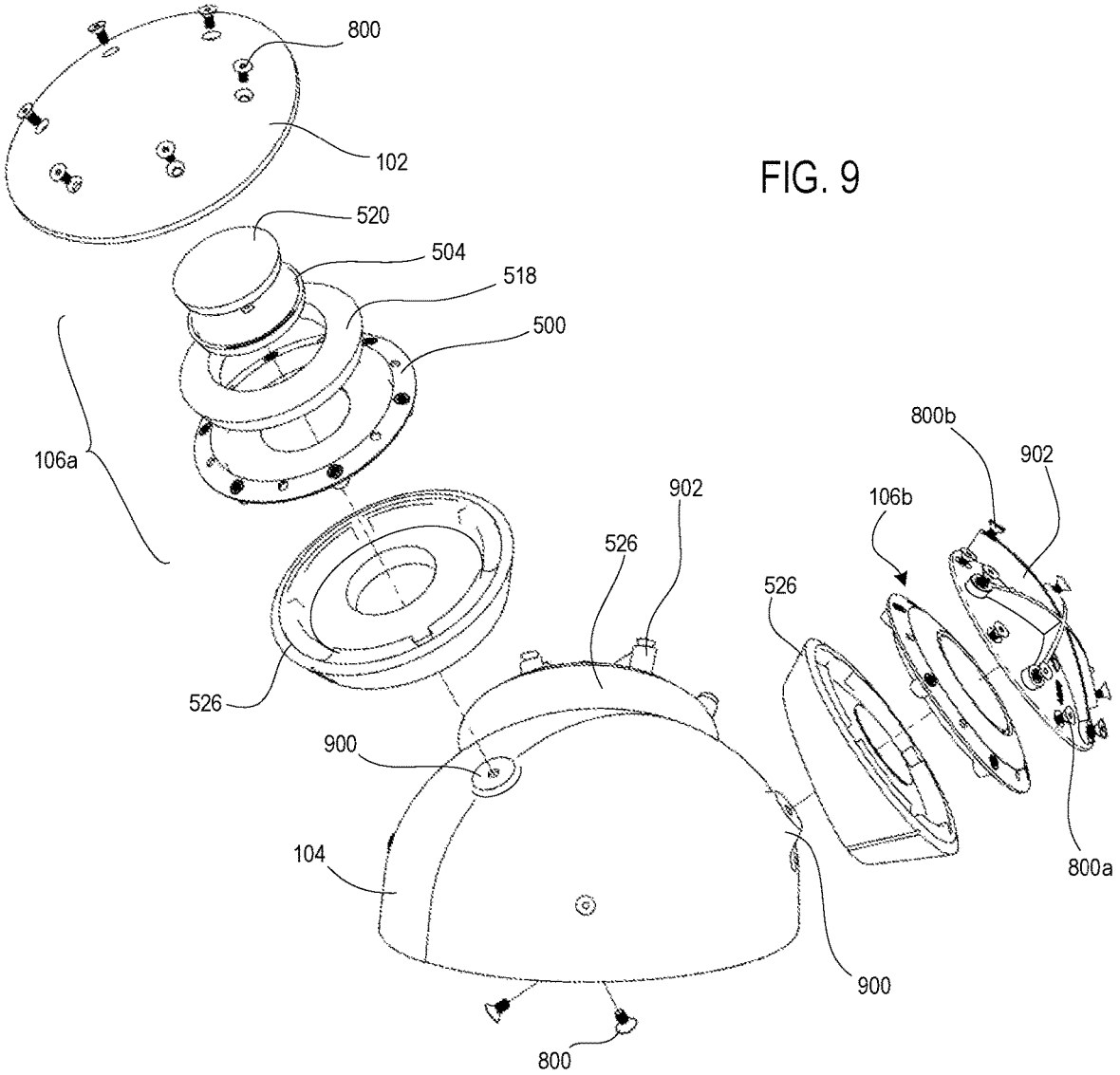
FIG. 9
FIG. 10
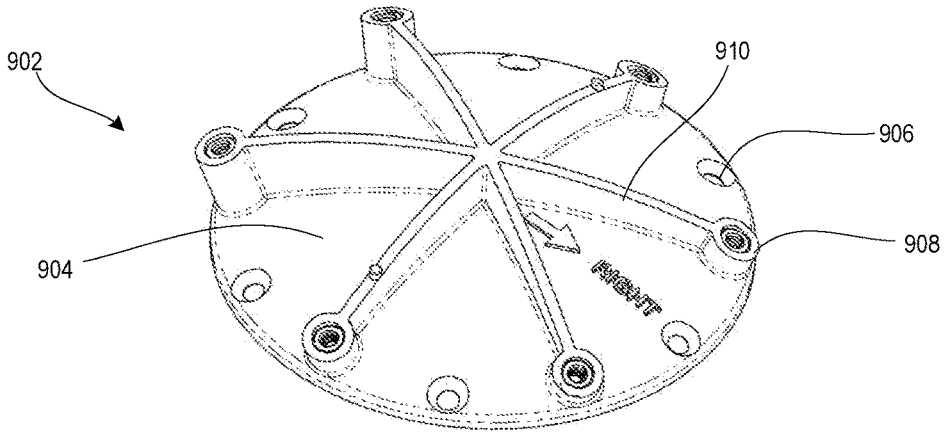

FIG. 29
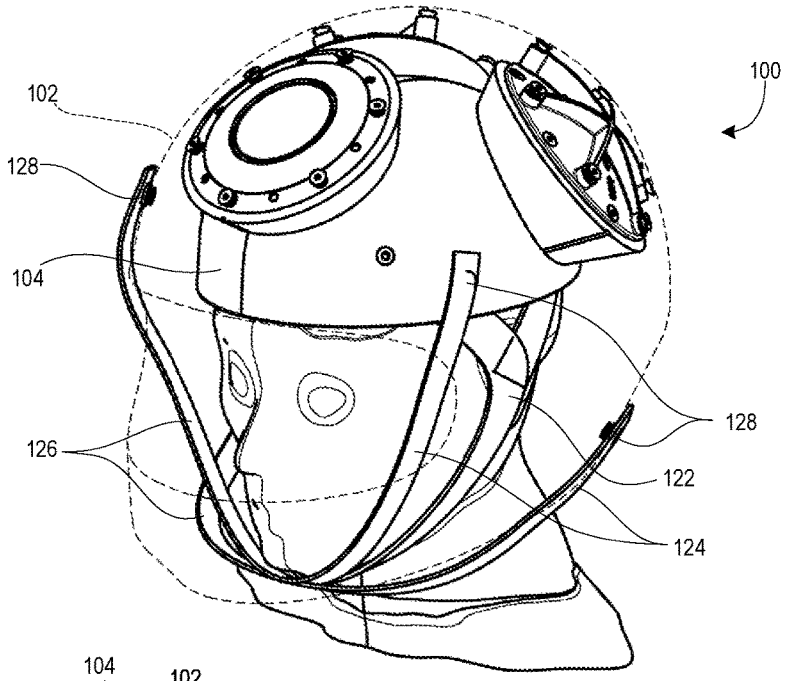
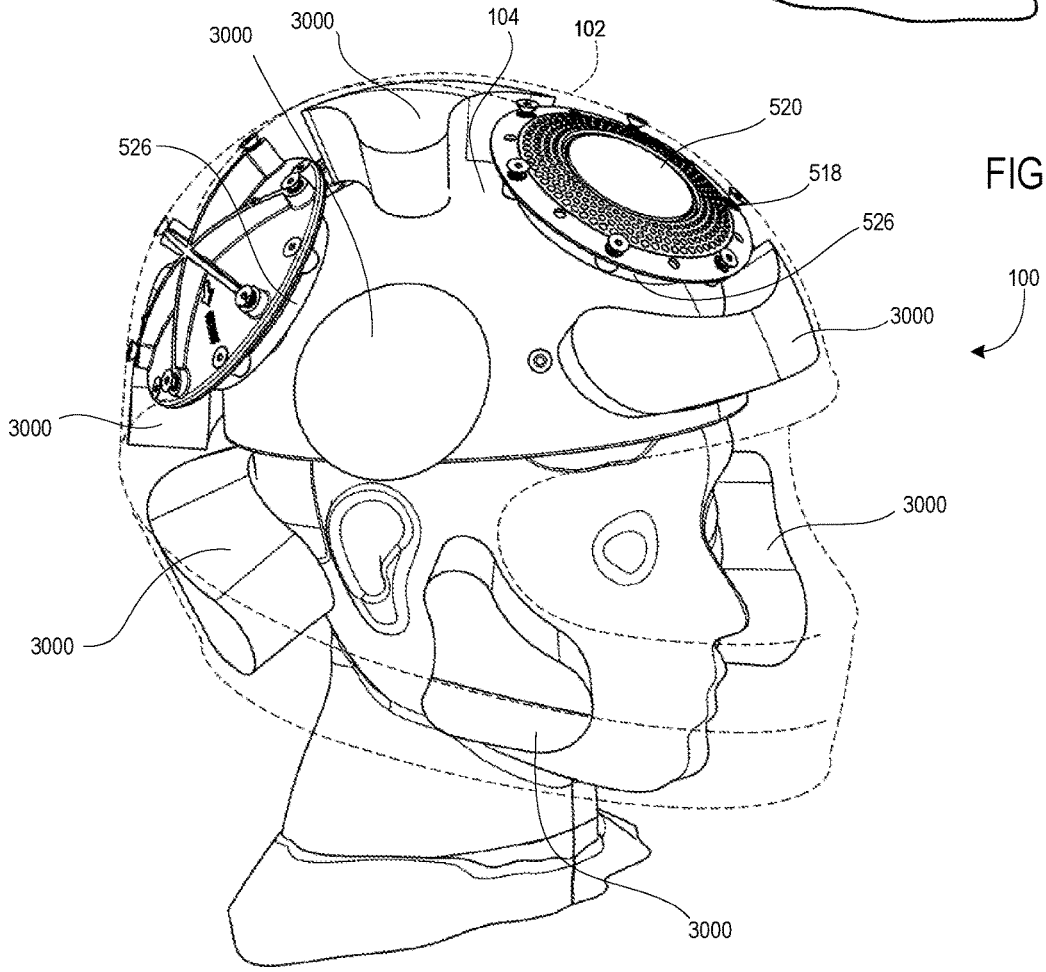
FIG. 30

HELMET SYSTEM

FIELD OF THE INVENTION

The invention relates generally to the field of protective headgear, and more particularly, to helmet systems providing improved impact dispersion and attenuation.

BACKGROUND

Conventionally, participants in "contact" sports (e.g., wrestling, football, rugby, baseball, lacrosse, cricket, skiing, snowboarding, hockey, skateboarding, action sports, snow spots, and bicycling) wear protective headgear to cushion the force of impacts that are regularly received during those events. Similarly, participants in other sport activities, such as bicycling, skiing, horseback riding, and so on, often wear protective headgear to protect against occasional falls or contact with environmental obstacles.

In recent years, the effectiveness of protective headgear has been a subject of close scrutiny. Despite recent efforts to reduce injuries from head impacts, participants in certain contact sports have been experiencing an increased frequency of such injuries. This might be attributed to such efforts being focused on adding impact padding, without a complete understanding of the possible negative effects of adding weight to the headgear.

In any event, there exists a need to develop and provide improved protective headgear to reduce the frequency and severity of injuries caused during contact sports and other activities that present a risk of head injuries.

SUMMARY

In accordance with one aspect, there is provided a helmet system having an outer helmet, an inner helmet, and a first orbital connector joining the outer helmet to the inner helmet. The first orbital connector has a slip disc housing, a slip disc, and a post. The slip disc housing is mounted on one of the outer helmet and the inner helmet, and has a first face and an opening through the first face. The slip disc has a second face abutting the first face, the second face being movable in sliding contact with the first face relative to a spherical center. The post extends through the opening and mounts the slip disc to the other of the outer helmet and the inner helmet. The post is dimensioned to move within the opening to allow the second face to move tangentially to the spherical center in sliding contact with the first face.

In some exemplary aspects, the slip disc housing is mounted to the outer helmet and the slip disc is mounted to the inner helmet.

In some exemplary aspects, the slip disc housing is mounted to the inner housing and the slip disc is mounted to the outer helmet.

In some exemplary aspects, wherein the first orbital connector further comprises: a housing perimeter wall attached to and extending away from an outer perimeter of the first face; a disc perimeter wall attached to the slip disc and extending away from the first face; and a resilient barrier positioned between the housing perimeter wall and the disc perimeter wall, at least a portion of the resilient barrier being deformable to allow the second face to move tangentially to the spherical center in sliding contact with the first face. The resilient barrier may have one or more holes configured to selectively reduce a resilience of the resilient barrier in a direction tangential to the spherical center.

In some exemplary aspects, the first orbital connector further comprises a resilient pad extending from the slip disc to the one of the outer helmet and the inner helmet, the resilient pad being compressed to generate a restoring force against the slip disc and the one of the outer helmet and the inner helmet, wherein the restoring force generates a frictional force to frictionally hold the slip disc relative to the slip disc housing. The first orbital connector may also have a disc perimeter wall attached to the slip disc and extending away from the first face, and the resilient pad may be contained, in a direction tangential to the spherical center, within the disc perimeter wall.

In some exemplary aspects, the first orbital connector further comprises a housing perimeter wall attached to and extending away from an outer perimeter of the first face, and a plurality of fastener interfaces surrounding the housing perimeter wall and facing away from the first face, the plurality of fastener interfaces each being configured to receive a respective fastener to rigidly connect the first face to the one of the outer helmet and the inner helmet.

In some exemplary aspects, the post comprises a flexible spacer connected between the slip disc and the other of the outer helmet and the inner helmet. The post may have a fastener interface facing away from the second face and configured to receive a fastener to rigidly connect the post to the other of the outer helmet and the inner helmet.

In some exemplary aspects, the first orbital connector further comprises a resilient support positioned between the slip disc housing and the other of the outer helmet and the inner helmet. The resilient support may have a support opening surrounding the post, wherein the post is dimensioned to move within the support opening to allow the second face to move tangentially to the spherical center in sliding contact with the first face.

In some exemplary aspects, the outer helmet comprises: a main body configured to surround a wearer's superior and posterior skull regions, an anterior opening configured to be adjacent the wearer's eyes, and a chin guard extending from the main body and below the anterior opening and configured to surround the wearer's chin.

In some exemplary aspects, the inner helmet comprises: an outer shell and a foam layer located inside the outer shell, wherein the foam layer is configured to be more flexible than the outer shell.

In some exemplary aspects, the helmet system also includes an inner strap assembly comprising a first inner strap attached to a first lateral side of the inner helmet, and a second inner strap attached to a second lateral side of the inner helmet, and an outer strap assembly comprising a first outer strap attached to the first lateral side of the outer helmet, and a second outer strap attached to the second lateral side of the outer helmet. The first inner strap and the second inner strap may be configured to be connected to each other at a location below the wearer's chin, and the first outer strap and the second outer strap may be configured to be connected to each other at a location surrounding a front of the wearer's chin. The first inner strap and the second inner strap may be configured to be connected to each other at a location surrounding a front of the wearer's chin, and the first outer strap and the second outer strap may be configured to be connected to each other at a location below the wearer's chin.

In some exemplary aspects, the helmet system also includes one or more additional orbital connectors joining the outer helmet to the inner helmet. Each additional orbital connectors may have a respective slip disc housing and slip disc. The respective spherical centers of the first orbital connector and the respective spherical center of each of the one or more additional orbital connectors may be spherically concentric. In some cases, there may be two additional orbital connectors. In some cases, the first orbital connector is located at a medial, anterior position relative to the inner helmet and the outer helmet and the two additional orbital connectors are located at posterior and opposite lateral positions relative to the inner helmet and the outer helmet. In some cases, the first orbital connector is located at a first location at which the outer helmet is located a first distance from the inner helmet, and one of the one or more additional orbital connectors is located at a second location at which the outer helmet is a second distance from the inner helmet, the second distance being greater than the first distance, and the helmet system further comprises a spacer connecting the one of the one or more additional orbital connectors to the outer helmet. The spacer is dimensioned to hold the one of the one or more additional orbital connectors with its respective spherical center spherically concentric with the spherical center of the first orbital connector.

In another exemplary aspect, there is provided an orbital connector for a helmet system, which may be provided separately from the outer helmet and inner helmet.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures:

FIG. 9 is a partially exploded view illustrating multiple orbital connectors in various states of assembly with an inner helmet and an outer helmet.

FIG. 10 is a detail view of the spacer of FIG. 9.

FIG. 29 is an isometric view of another exemplary embodiment of a helmet system showing an alternative strap arrangement, with the outer helmet rendered transparently.

FIG. 30 is a front isometric view of another exemplary embodiment of a helmet system showing an alternative padding arrangement.

DETAILED DESCRIPTION OF EXEMPLARY EMBODIMENTS

Figure 1:
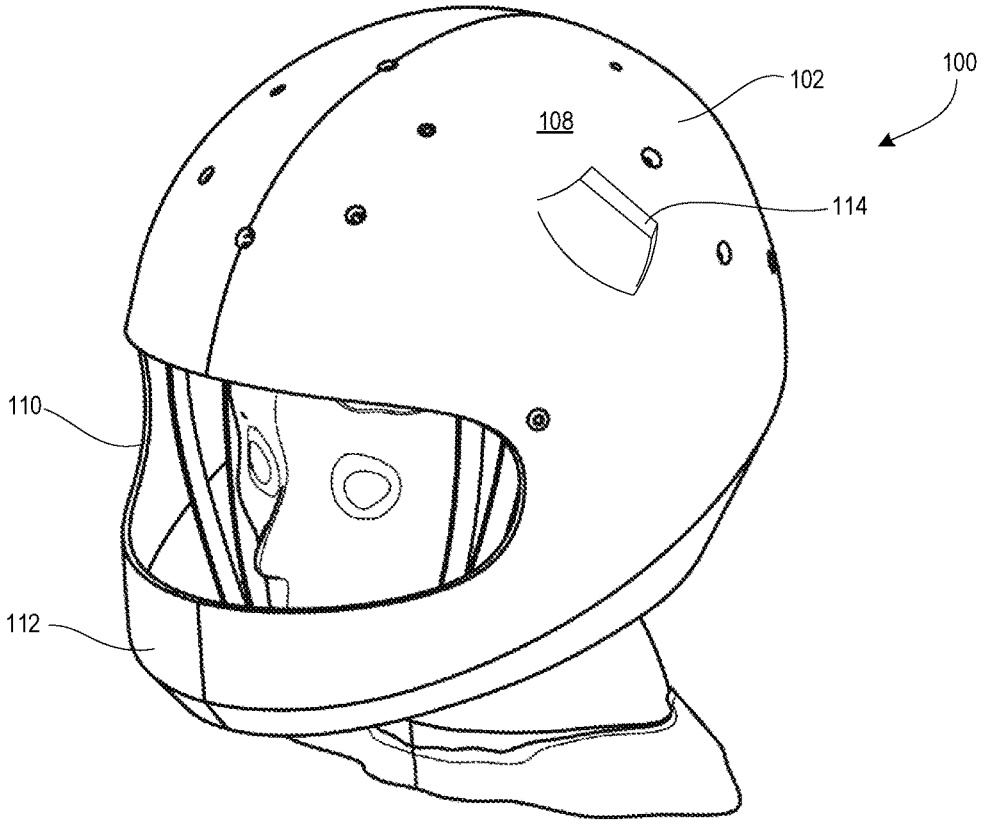
FIG. 1 is an isometric view of an exemplary embodiment of a helmet system.

The embodiments of the invention described herein relate to protective headgear in the form of helmet systems. As used herein, the term "helmet" is not intended to be limited, but is meant to encompass any headgear worn for protection during an activity in which an impact to the head may occur.

In general terms, embodiments described herein relate to helmet systems having an outer helmet, an inner helmet, and one or more orbital connectors that join the outer helmet to the inner helmet. The orbital connectors allow the outer and inner helmets to displace relative to one another along a spherical path. Such displacement is believed to be effective to mitigate the impact force in some circumstances. Embodiments may be provided as complete helmet assemblies, or as components of such assemblies (e.g., replacement orbital connectors or orbital connectors adapted to work in other helmet systems).

FIGS. 1 through 4 illustrate an example of a helmet system 100 having an outer helmet 102, an inner helmet 104, and orbital connectors 106 joining the outer helmet 102 to the inner helmet 104. The outer helmet 102 preferably comprises a rigid shell structure formed from molded or layered plastics, composites, or the like. Exemplary materials include layers, weaves or random distributions of aramid (e.g., KEVLAR™) fibers, carbon fibers, glass fibers, and so on, that are rigidly bound together by a resin matrix. Other exemplary materials include plastics, such as polycarbonate, ABS (acrylonitrile butadiene styrene), and so on. The outer helmet 102 material preferably is relatively rigid, impact resistant, and lightweight.

The exemplary outer helmet 102 is formed with a main body 108 that is configured to surround the wearer's superior and posterior skull regions (i.e., the top and back of the head), an anterior opening 110 that is configured to be adjacent the wearer's eyes to permit viewing through the outer helmet 102, and a chin guard 112 that extends from the main body 108 and below the anterior opening 110 and is configured to surround the wearer's chin. One or more air vents 114 also may be provided, and a visor or facemask (not shown) may be installed over the anterior opening 110. It will be understood that this configuration is exemplary, and other embodiments may lack the chin guard 112, or have other shapes or features as generally known in helmet design.

The inner helmet 104 also preferably comprises a rigid outer shell 116 comprising materials such as those described above, and a pliable inner shell 118 comprising an impact-absorbing material such as those discussed below. The inner shell 118 is configured to receive a portion of the wearer's head, and may include moldable or repositionable padding or the like to help with customizing the fit for the particular wearer. The outer shell 116 and inner shell 118 are configured, via material selection and dimensioning of the parts, such that the inner shell 118 is more flexible than the outer shell 116. Thus, loads on the inner helmet 104 will generally tend to deform the inner shell 118 to a greater degree than the outer shell 116.

Figure 2:
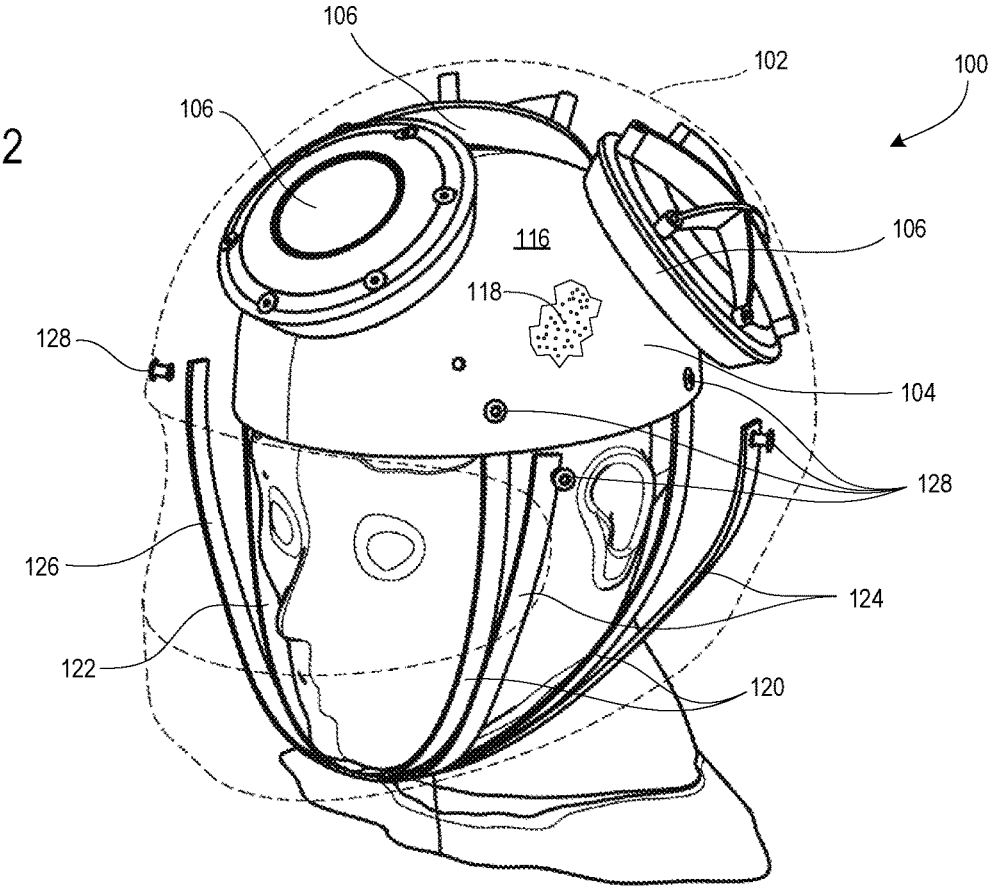
FIG. 2 is an isometric view of the helmet system of FIG. 1, with the outer helmet rendered transparently.

The helmet system 100 also may include a strap system for securing the helmet system 100 to the wearer's head. The shown strap system comprises an inner strap assembly for securing the inner helmet 104 to the wearer's head, and an outer strap assembly for securing the outer helmet 102 to the wearer's head. The inner strap assembly includes a first inner strap 120 attached to a first lateral side of the inner helmet 104, and a second inner strap 122 attached to a second lateral side of the inner helmet 104. Each inner strap 120, 122 may comprise multiple portions (i.e., multiple strap elements), such as shown in FIG. 2. Similarly, the outer strap assembly includes a first outer strap 124 attached to a first lateral side of the outer helmet 102, and a second outer strap 126 attached to a second lateral side of the outer helmet 102. Permanent or releasable connectors 128, such as rivets, bolts, screws, snaps, or the like, may be used to secure the strap assemblies to the outer helmet 102 and inner helmet 104.

Each strap assembly may include suitable clasps, snaps or other connectors to hold the strap assembly in place. The strap assemblies also may be configured as chin straps (i.e., straps that are connected to each other to surround the front of the wearer's chin), or as under-chin straps (i.e., straps that are connected to each other at a location below the wearers chin). In FIG. 2, the outer strap assembly and inner strap assembly are both configured as under-chin straps. Each strap assembly may have a separate openable clasp to connect below the chin, or the straps 120, 122, 124, 126 may be joined by a single openable clasp (e.g., straps 120 and 124 terminate at a first clasp element, and straps 122 and 126 terminate at a second clasp element, and the first and second clasp elements are connectable by snap connectors, latches, hooks or the like). Other alternatives and variations will be apparent to persons of ordinary skill in the art in view of the present disclosure. For example, one or both strap assemblies may be omitted or replaced by different strap assemblies or holding systems.

Figure 3:
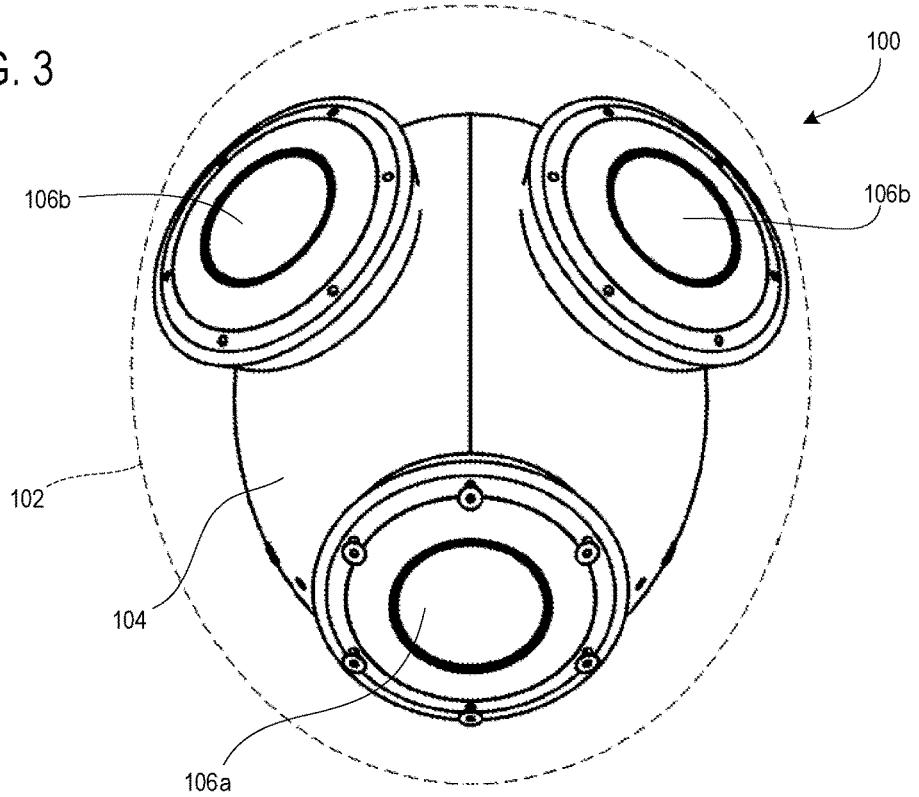
FIG. 3 is a top plan view of the helmet system of FIG. 1, with the outer helmet rendered transparently.
Figure 4:
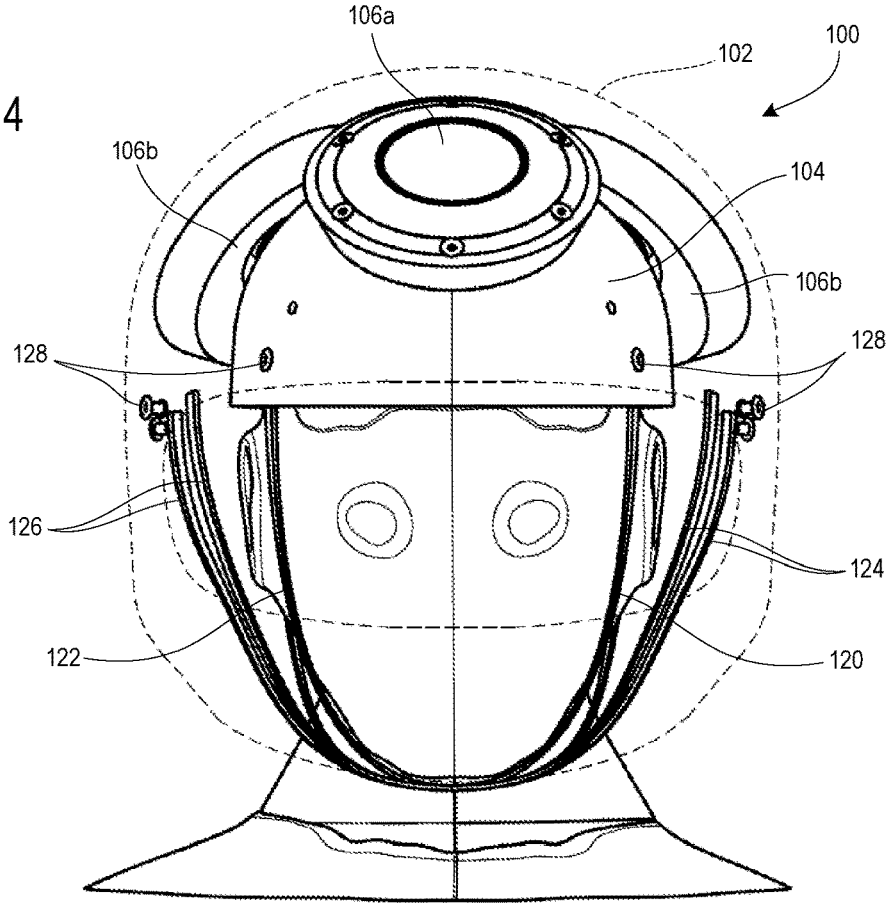
FIG. 4 is a front elevation view of the helmet system of FIG. 1, with the outer helmet rendered transparently.

The orbital connectors 106 are arranged to deflect and absorb impact loads that might come from a variety of directions. For example, as best shown in FIGS. 3 and 4, three orbital connectors 106 may join the outer helmet 102 to the inner helmet 104, and be configured with a front orbital connector 106*a* at a medial, anterior position relative to the inner helmet 104 and the outer helmet 102, and the two rear orbital connectors 106*b* located at posterior and opposite lateral positions relative to the inner helmet 104 and the outer helmet 102. This configuration is expected to be suitable for addressing impacts that occur in contact sports, such as American football, which might be coming from virtually any direction relative to the helmet system 100. The use of three or more orbital connectors 106 is preferred to ensure that at least one orbital connector 106 is at or near the point of impact. However, more than three orbital connectors 106 may be used, and may be preferable if the orbital connectors 106 are relatively small. Also, fewer than three orbital connectors 106 may be used, in which case additional padding might be positioned between the outer helmet 102 and inner helmet 104 to enhance protection against impacts coming from different directions.

Figure 5:
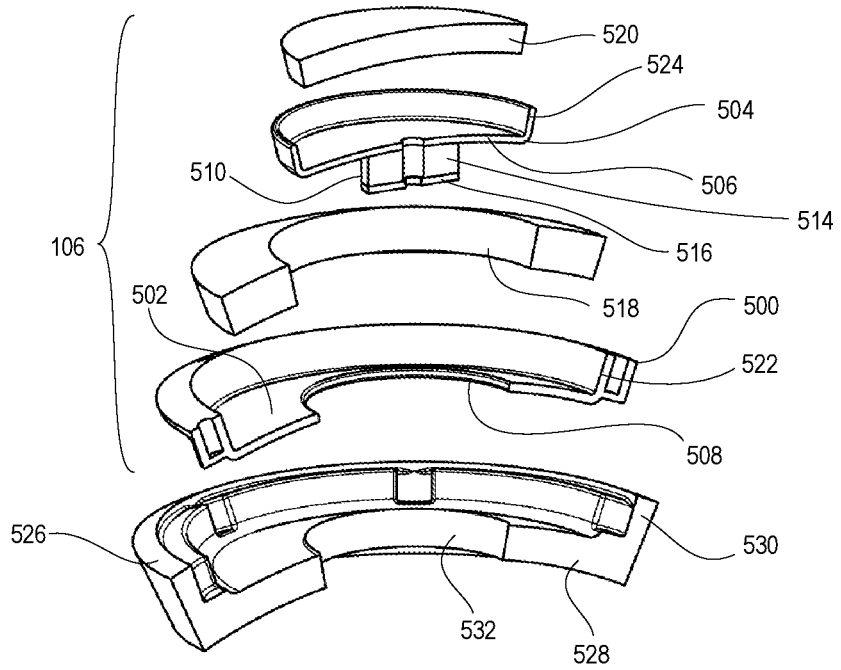
FIG. 5 is an exploded cutaway view of an exemplary orbital connector and resilient support.
Figure 6:
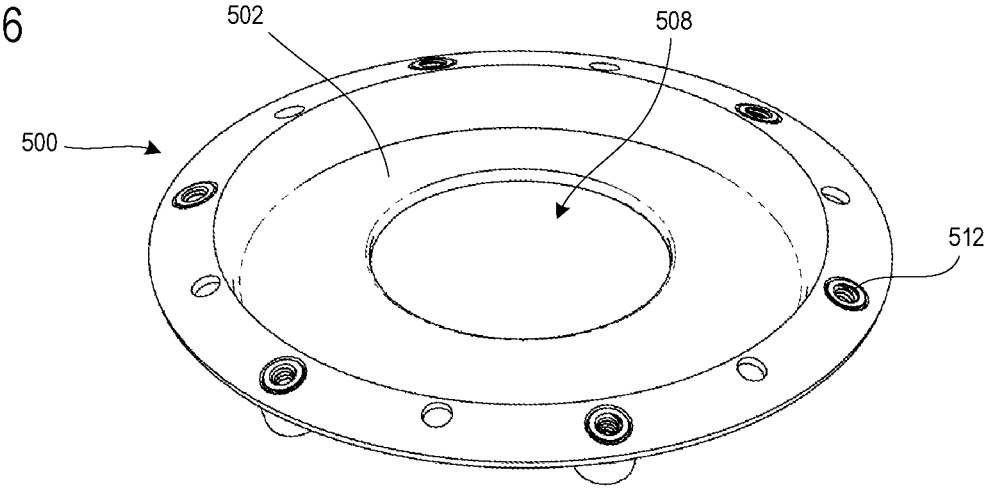
FIG. 6 is a detail view of the slip disc housing of the embodiment of FIG. 5.
Figure 7:
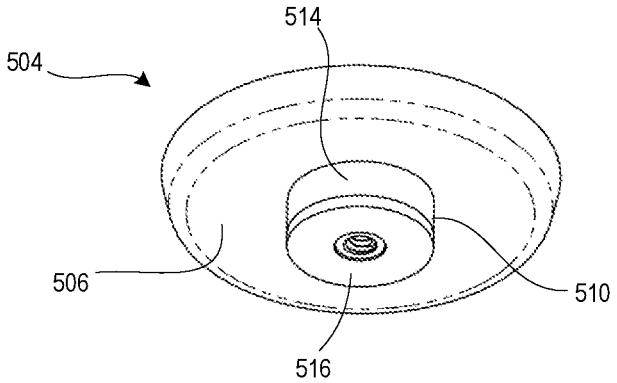
FIG. 7 is a detail view of the slip disc and post of the embodiment of FIG. 5.

Details of an exemplary orbital connector 106, and how they are connected to the outer helmet 102 and inner helmet 104, are illustrated in FIGS. 5 through 10. As best shown in FIGS. 5 through 7, each orbital connector 106 includes a slip disc housing 500 having a first face 502, and a slip disc 504 having a second face 506. In this case, the slip disc housing 500 is mounted with the first face 502 facing towards the outer helmet 102, and the slip disc 504 is mounted with the second face 506 facing towards the inner helmet 104. The first face 502 and second face 506 face each other and abut each other directly or via an intermediate layer of bearing material (e.g., lubricant, polytetrafluoroethylene sheet, or the like).

Figure 8:
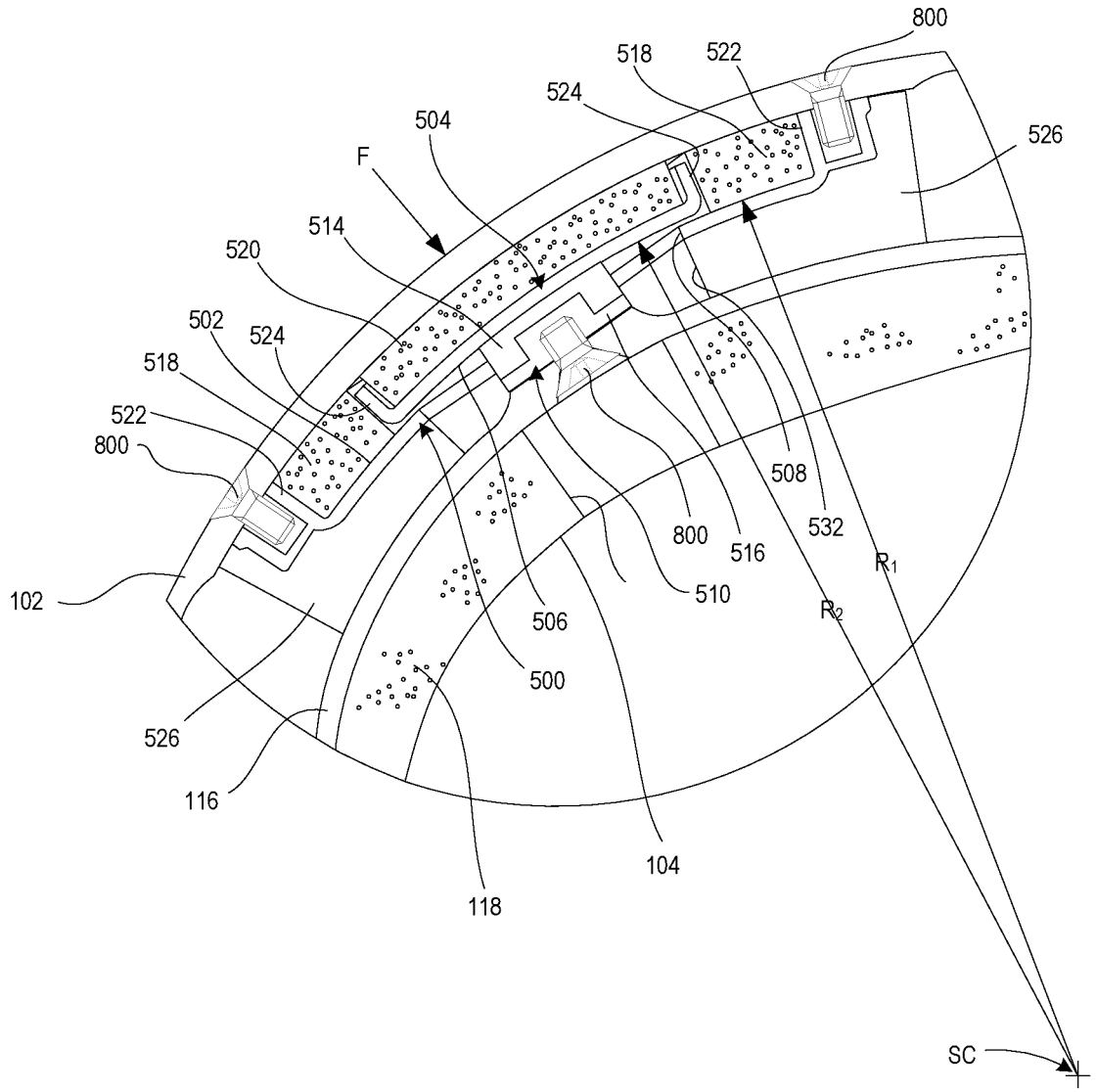
FIG. 8 is a cross-sectional side elevation view of the orbital connector of FIG. 5, shown attached to a helmet system.

The first face 502 and second face 506 preferably are configured to slide relative to each other about a common spherical center SC. For example, the first face 502 and second face 506 may have matching radii of curvature, such that the second face 506 can slide smoothly along the first face 502 while maintaining contact with the first face 502. An example of this is illustrated in FIG. 8, in which the first face 502 may have a first radius of curvature $R_1$ about a spherical center SC, and the second face 506 may have a second radius of curvature $R_2$ about the same spherical center SC, with the first radius of curvature $R_1$ and the second radius of curvature $R_2$ being equal or nearly equal (i.e., off by an amount attributable to normal manufacturing tolerances or an amount that does not affect performance as discussed below). The second face 506 also has a smaller area than the first face 502, as viewed radially with respect to its spherical center SC, which facilitates sliding of the second face 506 along the first face 502.

The first face 502 surrounds an opening 508 through the slip disc housing 500, and the slip disc 504 is attached to a post 510 that extends through the opening 508. The post 510 is dimensioned to move within the opening 508, such that it does not fully inhibit the relative sliding between the first face 502 and second face 506. In the shown example, the opening 508 and post 510 have respective circular cross sections as viewed radially from the spherical center SC, with the opening 508 being larger than the post 510 to allow the post 510 to move in any direction from a starting central position until (assuming nothing else stops the movement) the post 510 contacts the edge of the opening 508. In other embodiments, the cross section of the opening 508 may be selected to inhibit movement of the post 510, and thus limit sliding movement between the first face 502 and the second face 506. For example, the opening 508 could be shaped as a slot that allows relatively little movement of the post 510 in one direction, and relatively more movement of the post 510 in another direction. The opening 508 is also dimensioned to be smaller than the second face 506, such that the slip disc 504 cannot pass through the opening 508.

The orbital connector 106 is assembled to the outer helmet 102 and inner helmet 104 by securing the slip disc housing 500 to the outer helmet 102, and the slip disc 504 to the inner helmet 104. As shown in FIG. 8, the slip disc housing 500 may be attached to the outer helmet 102 by fasteners 800, such as rivets, bolts, screws (shown) or the like. If screws are used, the slip disc housing 500 may include threaded holes 512 formed by threading the material of the slip disc housing 500 or installing threaded inserts into the slip disc housing 500. In the example shown in FIG. 6, the slip disc housing 500 has six threaded holes 512, each formed by a threaded metal insert, surrounding the first face 502.

The slip disc 504 is mounted to the inner helmet 104 in a similar manner. Specifically, the slip disc 504 may be attached to the post 510 and the post 510 may be secured to the inner helmet 104 by a fastener 800 such as those described above. In the shown example, the fastener 800 is installed through an access hole 802 formed in the inner shell 118, which allows loosening of the fastener 800 to reposition or service the orbital connector 106. In other embodiments the inner shell 118 may cover the fastener 800, or the access holes 802 may be filled with additional impact attenuating material. The post 510 may be integrally formed with the slip disc 504 (i.e., both formed from a unitary molded or machined part). More preferably, the post 510 comprises an elastomeric support 514 that is secured to the slip disc 504, and a fastener interface 516 that is secured to the support 514. The support 514 provides a flexible connection between the slip disc 504 and the inner helmet 104, which is expected to help attenuate impact loads transmitted to the post 510, and help prevent the post 510 and slip disc 504 from being damaged by tensile loads during normal use. The support 514 may comprise any suitable elastomeric material, such as styrene-butadiene, natural rubber, isoprene, neoprene, nitrile rubbers, or the like. As shown in FIG. 8, the fastener interface 516 may include one or more threaded holes that each receive a respective fastener 800 extending through the outer shell 116 of the inner helmet 104. The fastener interface 516 may comprise metal, durable plastic, or the like, and may include threaded inserts to receive the fasteners 800.

When the orbital connector 106 is assembled, the second face 506 abuts the first face 502, and the first face 502 is located between the second face 506 and the inner helmet 104 to which it is attached by the post 510. Thus, the second face 506 is captured in place between the outer helmet 102 and the first face 502, and is constrained to slide along and in contact with the first face 502 along a spherical path (i.e., tangentially to the spherical center SC, or stated another way, in a direction that is perpendicular to the first radius of curvature $R_1$). The post 510 may connect the slip disc 504 to the inner helmet 104 with a tensile preload that pulls the second face 506 against the first face 502, to help assure sliding contact throughout the range of movement.

It will be understood from the forgoing that the orbital connector 106 is configured to allow the outer helmet 102 to move along a generally spherical path relative to the inner helmet 104. Such motion is expected to help divert impact loads to reduce the severity of impact experienced at the wearer's head. However, such movements preferably are restricted by absorb energy during the movement to reduce the severity of acceleration loads, and to prevent the outer helmet 102 from becoming improperly oriented relative to the inner helmet 104 (e.g., such that the outer helmet 102 impairs the wearer's vision). To these ends, the orbital connector 106 preferably includes a resilient barrier 518 located adjacent to the first face 502 and positioned to at least partially inhibit movement of the slip disc 504 relative to the slip disc housing 500, and to return the orbital connector 106 to (or near) the starting position at the end of an impact. In addition, the orbital connector 106 may include a resilient pad 520 that extends between the slip disc 504 and the outer helmet 102 to generate a friction force that holds the outer helmet 102 still relative to the inner helmet 104 until a force of sufficient magnitude is applied to the helmet system 100.

As best shown in FIGS. 5 and 8 the resilient barrier 518 may have an annular shape that fits into an annular space formed between a housing perimeter wall 522 and a disc perimeter wall 524. The housing perimeter wall 522 is formed as part of or otherwise attached to the slip disc housing 500, and extends away from an outer perimeter of the first face 502 towards the outer helmet 102.

Similarly, the disc perimeter wall 524 is formed as part of or otherwise attached to the slip disc 504, and extends away from the first face 502 towards the outer helmet 102. The resilient barrier 518 fits within the annular space, and preferably is in contact both the housing perimeter wall 522 and the disc perimeter wall 524. However, some embodiments may include a gap between the resilient barrier 518 and the housing perimeter wall 522 or the disc perimeter wall 524, in which case the gap will allow some degree of spherical sliding without impact attenuation until the resilient barrier 518 begins compression, and the slip disc 504 may not return to its starting position at the end of the impact.

The resilient barrier 518 may comprise any suitable impact absorbing material, such as those discussed below. The resilient barrier 518 also may comprise a pressurized resilient gas bladder, an arrangement of springs or smaller segments of elastomeric material, and so on. The degree of resilience and impact absorbing can be tailored by varying the shape of the resilient barrier 518, as known in the art and as discussed below.

As noted above, the resilient pad 520 is provided to hold the outer helmet 102 and inner helmet 104 in a fixed position until the helmet system 100 experiences a load of sufficient magnitude to overcome frictional contact between the resilient pad 520, slip disc 504 and outer helmet 102. The resilient pad 520 may be connected to the slip disc 504 by adhesives, fasteners, or the like. Alternatively, or in addition, the resilient pad 520 may be captured in place in the spherical direction by a disc perimeter wall 524 if one is provided. The resilient pad 520 is slightly compressed between the slip disc 504 and the outer helmet 102, thus generating a resilient restoring force against the slip disc 504 and outer helmet 102. This force generates friction at the interface between resilient pad 520 and outer helmet 102, which must be overcome to initiate spherical sliding of the slip disc 504 relative to the slip disc housing 500. Alternatively, the resilient pad 520 may be attached to the outer helmet 102, such that the slip disc 504 slides relative to the resilient pad 520 when a sufficiently large impact force is applied. The resilient pad 520 may comprise any suitable material, such as those discussed below. The resilient pad 520 also may include layers of additional material or surface treatments at the interface with the outer helmet 102 or slip disc 504 to modify the coefficient of friction at the interface, and thereby regulate the magnitude of load required to initiate the spherical sliding movement.

The resilient barrier 518 and resilient pad 520 also may be functional to absorb impact loads in a direction perpendicular to the outer helmet 102 surface. For example, an impact load F that strikes the outer helmet 102 as shown in FIG. 8 can be attenuated by compression of the resilient barrier 518 and resilient pad 520 along the line of the force F. Alternatively, or in addition to the resilient barrier 518 and resilient pad 520, the helmet system 100 may include supplemental impact attenuators between the orbital connector 106 and the inner helmet 104. For example, the helmet system 100 may include a resilient support 526 positioned between the slip disc housing 500 and the inner helmet 104. The shown exemplary resilient support 526 has an annular base 528 that is positioned between the slip disc housing 500 and the inner helmet 104, where it will compress under a load such as the shown impact force F. The resilient support 526 also may include an outer wall 530 that surrounds the slip disc housing 500 to help absorb tangential forces, and to keep the resilient support 526 properly centered on the slip disc housing 500. In this example, the resilient support 526 surrounds the slip disc housing 500 and has a support opening 532 through which the post 510 passes. The opening 532 is may be dimensioned to allow the post 510 to move a predetermined distance before contacting the opening 532 during sliding movement of the second face 506 relative to the first face 502. However, the opening 532 may be dimensioned to be contacted by the post 510 to provide additional impact attenuation at this interface. The exemplary resilient support 526 is captured in place relative to the orbital connector 106, and therefore it is not necessary to directly attach the resilient support 526 to any other part. However, in other cases, the resilient support 526 may be secured to the outer helmet 102, inner helmet 104 and/or slip disc housing 500 by adhesives or fasteners. Furthermore, the resilient support 526 may comprise other alternative structures, such as multiple separate parts that are positioned around the orbital connector 106, or the like. Other alternatives and variations will be apparent to persons of ordinary skill in the art in view of the present disclosure.

The resilient support 526 comprises an impact-absorbing material, such as those discussed below.

FIG. 9 illustrates the assembly of multiple orbital connectors 106 onto the inner helmet 104. A first orbital connector 106*a* is attached by connecting the post 510 of the slip disc 504 to a first mounting point 900 on the inner helmet 104 using a fastener 800, and by connecting the slip disc housing 500 to the outer helmet 102 using fasteners 800 (in FIG. 9, the post 510 is preassembled with the inner helmet 104 and not visible, and only a portion of the outer helmet 102 is shown). Thus, the first orbital connector 106*a* is secured between the outer helmet 102 and inner helmet 104 with a direct connection to each. The remaining orbital connectors 106*b* are attached directly to the inner helmet 104 via their respective posts 510. However, the remaining orbital connectors 106*b* are indirectly attached to the outer helmet 102 via respective spacers 902. The spacers 902 are configured to bridge gaps that might otherwise exist between the outer helmet 102 and the inner helmet 104. Such gaps may arise, for example, because the outer helmet 102 has a different shape than the inner helmet 104.

The spacers 902 may comprise any suitable shape and structure. For example, as best shown in FIG. 10, each spacer 902 may comprise a plate 904 that fits over the respective slip disc housing 500 and has holes 906 for securing the spacer 902 to the slip disc housing 500 using a first set of fasteners 800*a*. Mounting posts 908 extend from the plate 904 towards the outer helmet 102, and have respective threaded holes for receiving a second set of fasteners 800*b* to secure the spacer 902 to the outer helmet 102. Reinforcing ribs 910 and other structures may be provided to enhance the rigidity of the spacer 902. The spacer 902 also may include a layer of impact absorbing material (not shown) between the plate 904 and the outer helmet 102. In other embodiments, the entire spacer 902 may comprise an impact absorbing material that is bonded at one end to the slip disc housing 500 and the other end to the outer helmet 102. Other alternatives and variations will be apparent to persons of ordinary skill in the art in view of the present disclosure.

Figure 12:
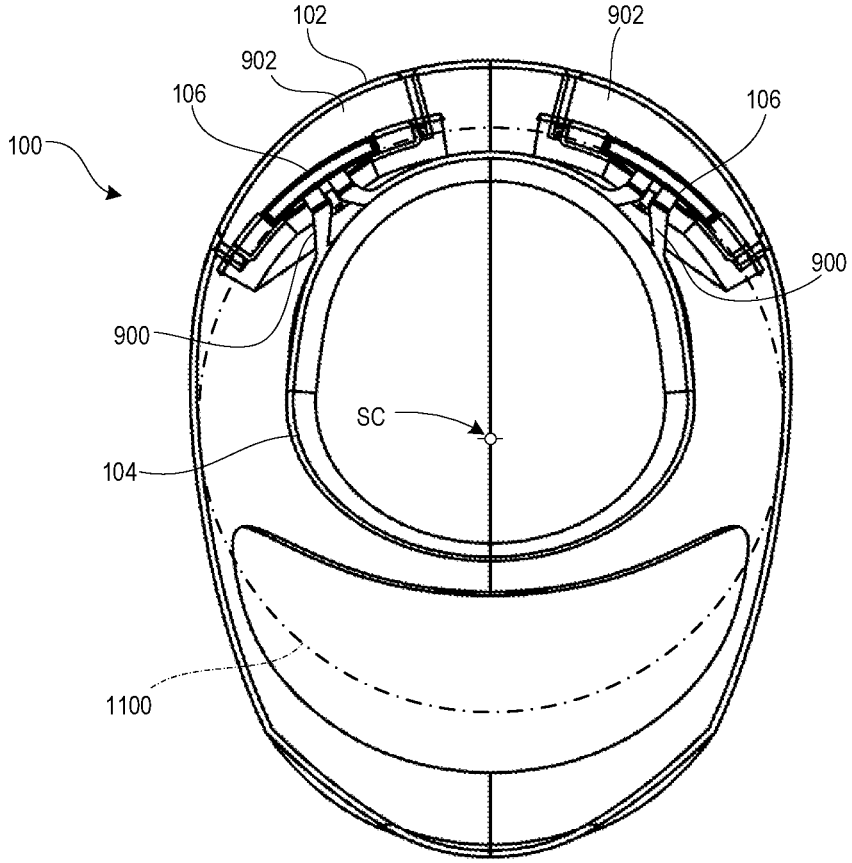
FIG. 12 is a bottom cross-sectional plan view of the helmet system of FIG. 1.

Spacers 902 alternatively or additionally may be provided between an orbital connector 106 and the inner helmet 104. For example, the mounting points 900 for each orbital connector 106 may have a different shape to hold the orbital connector 106 at a different distance from or orientation relative to the surrounding surface of the inner helmet 104, as shown in FIGS. 9 and 12. In other cases, none of the orbital spacers 106 may require a spacer 902. For example, each orbital connector 106 may have a custom-shaped slip disc housing 500 that eliminates the need for a spacer 902, or the gap between the outer helmet 102 and inner helmet 104 may be uniform at each orbital connector 106 location such that an identical orbital connector 106 may be used without any spacers 902.

Figure 11:
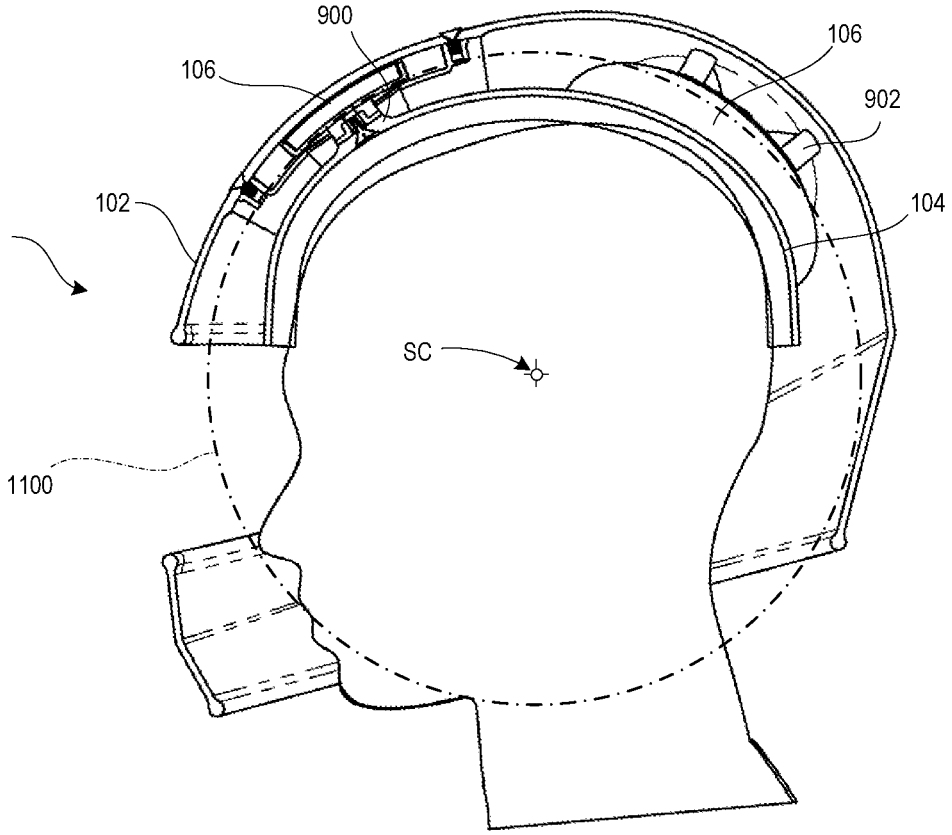
FIG. 11 is a cross-sectional side elevation view of the helmet system of FIG. 1 as shown on a wearer's head.

In embodiments having multiple orbital spacers 106, the orbital spacers 106 are preferably arranged such that they slide around a common spherical center SC. This principle is illustrated in FIGS. 11 and 12. Here, the three orbital spacers 106 are all arranged with their respective first faces 502 having a common radius of curvature $R_1$ and a common spherical center. Thus, all of the first faces 502 are spherically concentric, and the outer helmet 102 will slide about a single spherical path 1100 relative to the inner helmet 104. This arrangement allows the each orbital connector 106 to slide in unison with the remaining orbital connectors 106, such that the outer helmet 102 moves uniformly relative to the inner helmet 104. If the outer helmet 102 and inner helmet 104 are spherical in shape, this arrangement can be achieved simply by attaching identical orbital spacers 106 at various locations between the outer helmet 102 and inner helmet 104. However, if the outer helmet 102 and inner helmet 104 are not spherical (such as shown), then mounting posts 900 and spacers 902 of various shapes may be used to help facilitate proper placement of the orbital connectors 106 at the desired locations.

The foregoing concentric sliding is preferred because it is expected to allow relatively free movement of the outer helmet 102 relative to the inner helmet 104, and allow control of that sliding movement using a selection of impact absorbing structures such as resilient barriers 518 and the like. However, this arrangement is not strictly necessary in all embodiments. For example, embodiments having a single orbital connector 106 will not have this arrangement. As another example, one or more of the orbital spacers 106 may slide about a different spherical center SC, but binding can be avoided by allowing the outer helmet 102 or inner helmet 104 to flex to accommodate such independent movement. This may be accomplished by surrounding the interface between the orbital connector 106 and the outer helmet 102 with slots or flexible material that allows the orbital connector 106 to slide along a different spherical center SC than the other orbital connectors 106.

The embodiments described thus far can be modified in a variety of ways. Examples of such modifications are shown in the remaining Figures.

Figure 13A:
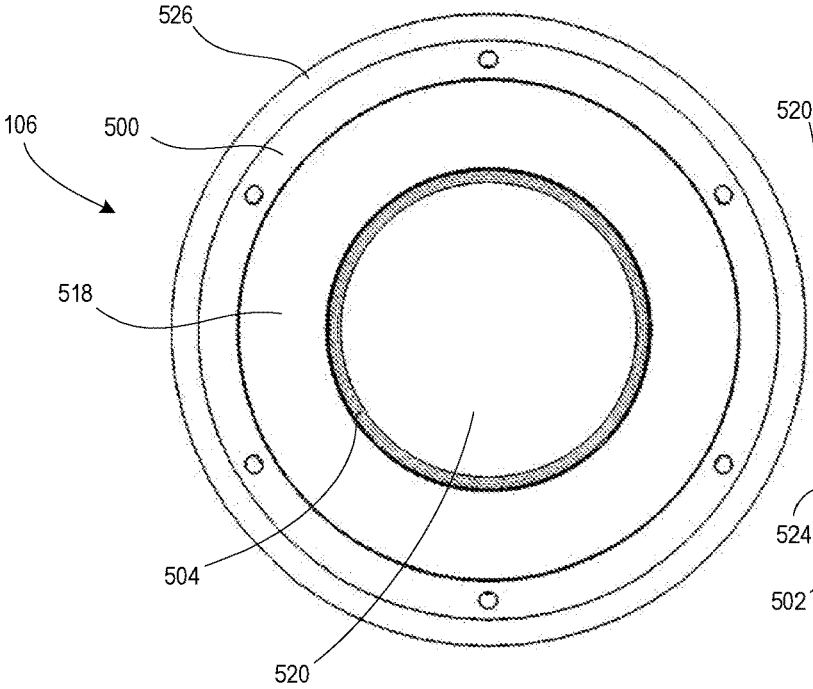
FIGS. 13A and 13B are plan and cross-sectional side views, respectively, of an exemplary orbital spacer in a rest position.
Figure 13B:
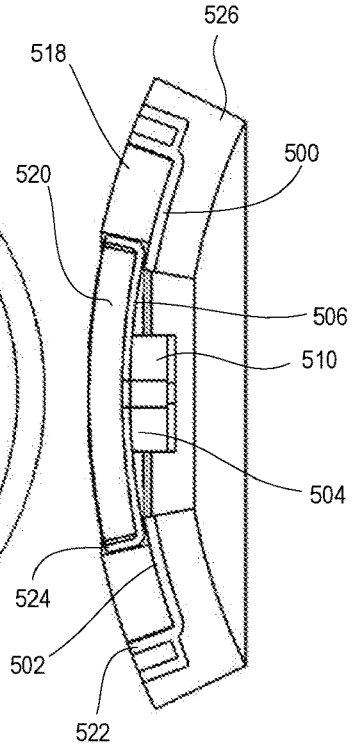

FIGS. 13A and 13B illustrate one embodiment of an orbital connector 106. In this embodiment, the resilient barrier 518 fits tightly between the slip disc housing 500 and slip disc 504 (more specifically, between the housing perimeter wall 522 and the disc perimeter wall 524). Thus, the slip disc 504 cannot move relative to the slip disc housing 500 without compressing at least a portion of the resilient barrier 518. This configuration is expected to provide uniform impact attenuation in all sliding directions.

Figure 14A:
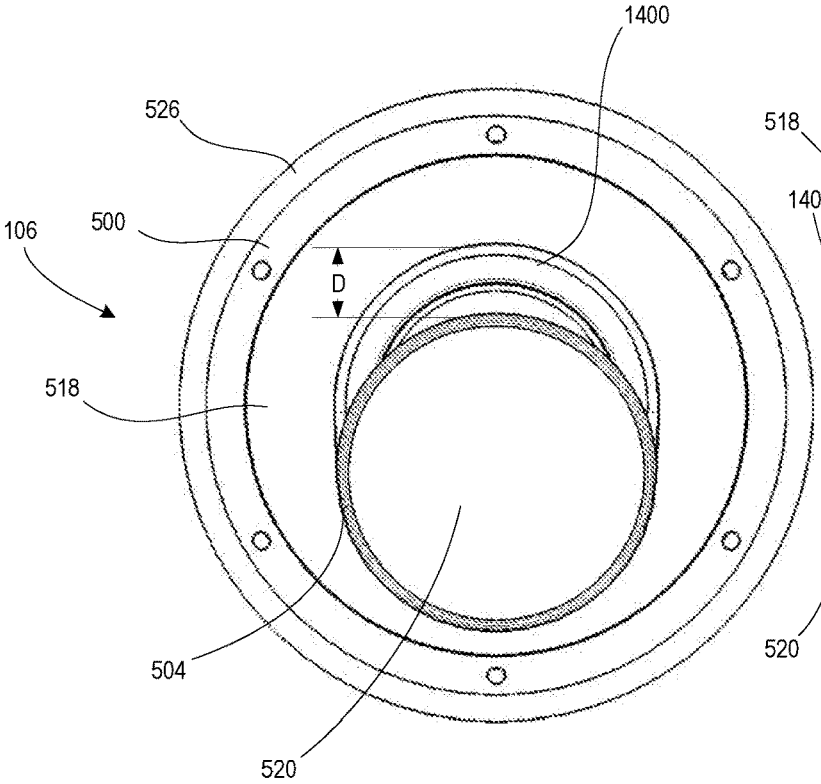
FIGS. 14A and 14B are plan and cross-sectional side views, respectively, of the orbital spacer of FIGS. 13A and 13B in a deformed state during an impact load.
Figure 14B:
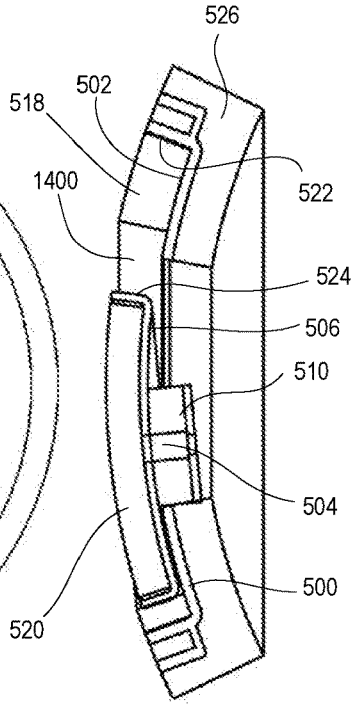

FIGS. 14A and 14B show the embodiment of FIGS. 13A and 13B during an impact loading. In this case, the resilient barrier 518 deforms to allow the slip disc 504 to spherically slide relative to the slip disc housing 500. In this case, the resilient barrier 518 may distort as shown, by elongating to form a gap 1400 between the disc perimeter wall 524 and the resilient barrier 518. At the end of the impact, the resilient barrier 518 preferably exerts a resilient force to reposition the slip disc 504 at the starting location shown in FIG. 13A.

Figure 15:
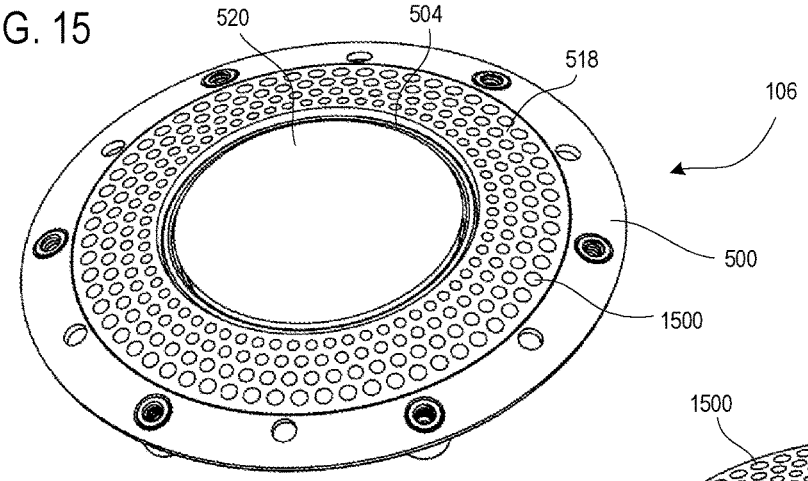
FIG. 15 illustrates another exemplary embodiment of an orbital spacer.
Figure 16:
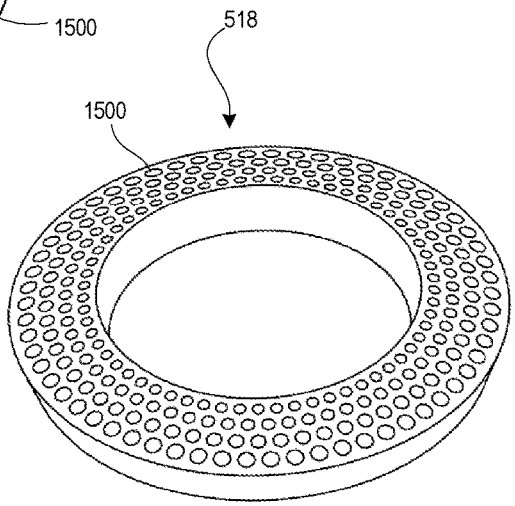
FIG. 16 is a detail view of the resilient barrier of the orbital spacer of FIG. 15.

FIGS. 15 and 16 illustrate another alternative orbital connector 106. In this case, the orbital connector 106 has an resilient barrier 518 having a plurality of holes 1500. The holes 1500 reduce the resilience of the resilient barrier 518, thereby allowing the resilient barrier 518 to compress more easily. In the shown example, the holes 1500 are provided in a uniform pattern of concentric rings, to provide uniform impact attenuation in all directions. The holes 1500 alternatively may be provided in a non-uniform pattern to provide different degrees of impact attenuation depending on the impact direction.

Figure 17:
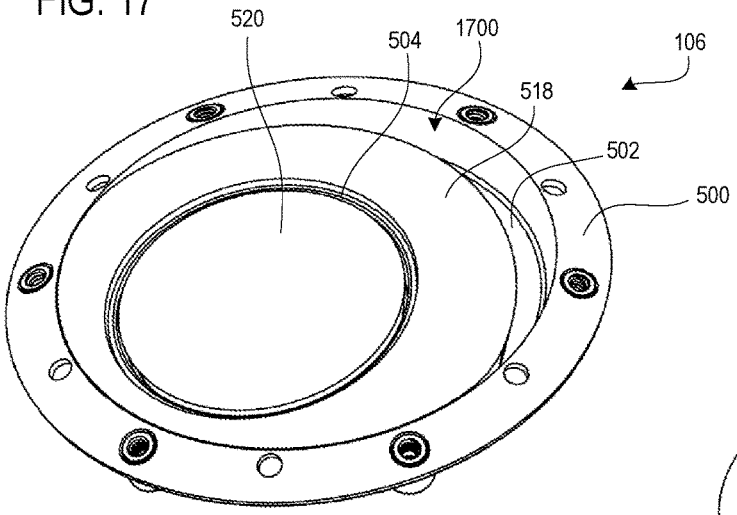
FIG. 17 illustrates the orbital spacer of FIG. 15 in a deformed state during an impact load.
Figure 18:
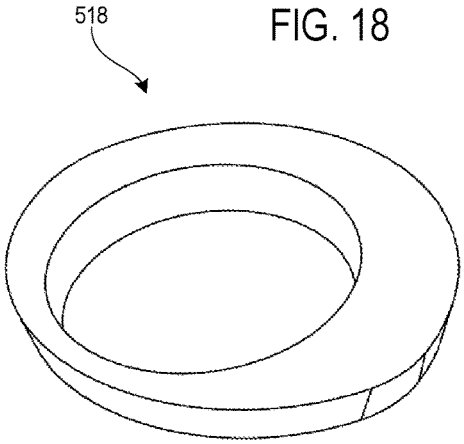
FIG. 18 is a detail view of the resilient barrier of the orbital spacer of FIG. 15 in a deformed state during an impact load.

FIGS. 17 and 18 show the embodiment of FIGS. 15 and 16 during an impact loading, with the holes 1500 omitted for simplicity of illustration. In this case, the slip disc 504 spherically slides relative to the slip disc housing 500, and the resilient barrier 518 moves with the slip disc 504, thus forming a gap 1700 between the resilient barrier 518 and the housing perimeter wall 522. After the impact, the resilient barrier 518 exerts a resilient force to reposition the slip disc 504 at the starting position shown in FIG. 15.

Figure 19:
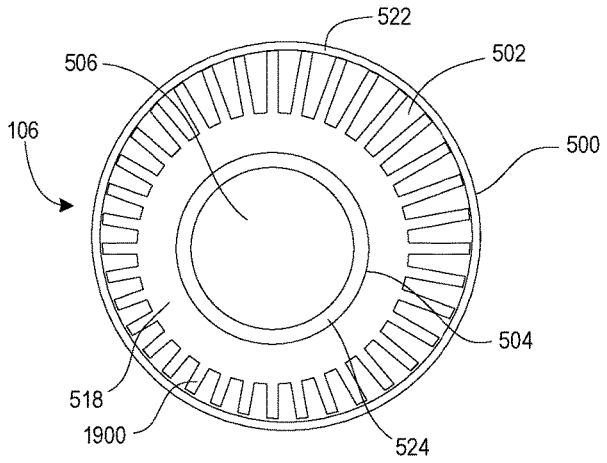
FIG. 19 is a plan view of another alternative embodiment of an orbital spacer.

FIG. 19 shows another exemplary orbital connector 106 having two variations on the orbital connectors 106 shown in FIGS. 13A through 18. First, the resilient barrier 518 is formed with radial arms 1900 instead of a solid (or perforated) block of material. This allows the resilience of the resilient barrier 518 to be modified depending on the angle of impact, such as by changing the spacing or thickness of the arms 1900. Second, the arms 1900 have different lengths extending from a central ring 1902, to thereby locate the slip disc 504 at a predetermined non-centered location relative to the slip disc housing 500. This may be useful to help locate the orbital connector 106 at the desired location relative to the outer helmet 102 and inner helmet 104, and to adjust user fit. Other examples may use other shapes for the resilient barrier 518, and the resilient barrier 518 may have other modifications to regulate the resilience of the resilient barrier 518, such as regions of different depth (i.e., thickness along the radius of the spherical center SC), cutouts of various shape, or the like.

Figure 20:
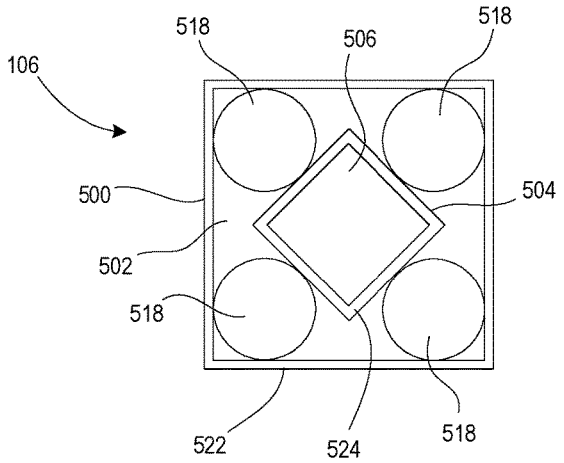
FIG. 20 is a plan view of another alternative embodiment of an orbital spacer.

FIG. 20 illustrates another example of an orbital connector 106. In this case, the housing perimeter wall 522 and the disc perimeter wall 524 are both non-circular. In addition, the resilient barrier 518 is provided as a plurality of discs of material that may or may not be connected to each other. In other examples, one of the housing perimeter wall 522 and the disc perimeter wall 524 may be circular and the other may be non-circular, or they could have other different geometric shapes.

It will be understood from the foregoing, that the orbital connector 106 may have a variety of different shapes and configurations, while still providing a spherical sliding function to help redirect and attenuate impact loads. In the previous embodiment, such spherical sliding is provided at an interface between the first face 502 and second face 506, in which the first face 502 and second face 506 both comprise continuous hemispherical surfaces (i.e., surfaces that extend continuously at a fixed distance from the spherical center SC. However, the use of continuous hemispherical surfaces is not strictly required.

Figure 21:
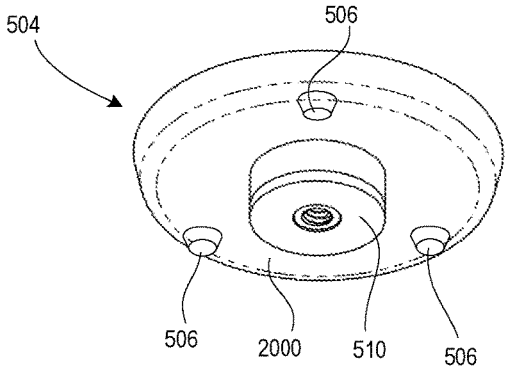
FIG. 21 is a detail view of alternative embodiment of a slip disc.

For example, one or the other of the first face 502 and second face 506 may comprise a discontinuous surface formed by discrete component faces that contact with the other of the first face 502 and second face 506. An example of this construction is shown in FIG. 21. Here, the second face 506 is formed by three or more discrete second face 506 segments that protrude from a base surface 2000 towards and into contact with the first face 502. The second face 506 segments have portions that are arranged at a common radius from a spherical center, and positioned such that they remain in contact with the second face 506 throughout the range of motion of the slip disc 504. For example, each face segment may comprise a small concave hemispherical surface that is concentric with the spherical center SC, a flat planar surface, a convex spherical surface, or any other shape that allows sliding tangentially to the spherical center SC. Thus, the slip disc 504 obtains the desired spherical sliding against the slip disc housing 500 by use of a discontinuous surface.

Figure 22:
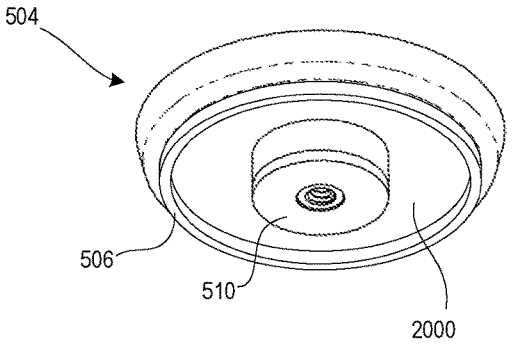
FIG. 22 is a detail view of another alternative embodiment of a slip disc.

FIG. 22 shows another alternative example of a second face 506. In this case, the second face 506 is formed as a circular rib that protrudes from a base surface 2000 of the slip disc 504. Other embodiments may have surfaces having different shapes (e.g., cross shapes, square shapes, etc.). These and other variations can also be made to the first face 502. In any case, the first face 502 and second face 506 should be configured such that they do not have gaps or discontinuities that would interrupt the spherical sliding motion between the slip disc housing 500 and the slip disc 504.

Figure 23:
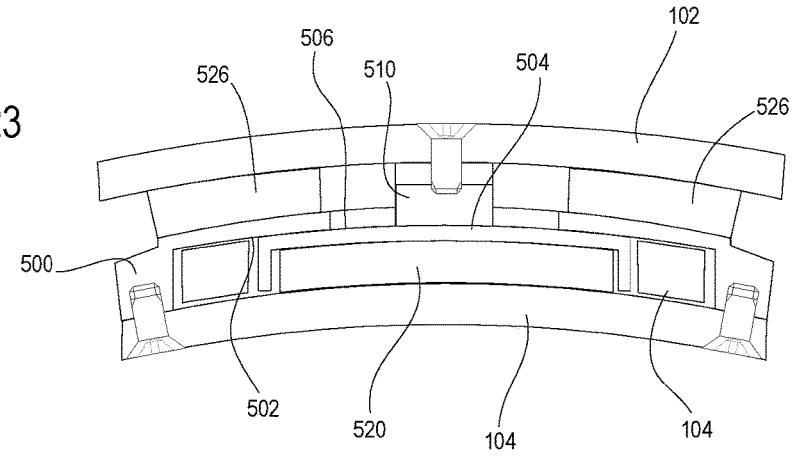
FIG. 23 is a cutaway side view of another alternative embodiment of an orbital spacer.

Another alternative embodiment is illustrated in FIG. 23. This embodiment is generally the same as the embodiment shown in FIG. 8, but the slip disc housing 500 is mounted to the inner helmet 104, and the slip disc 504 is mounted to the outer helmet 102. In this example, the parts have the reverse orientation, but otherwise operate in the same manner as previously described.

Figure 24:
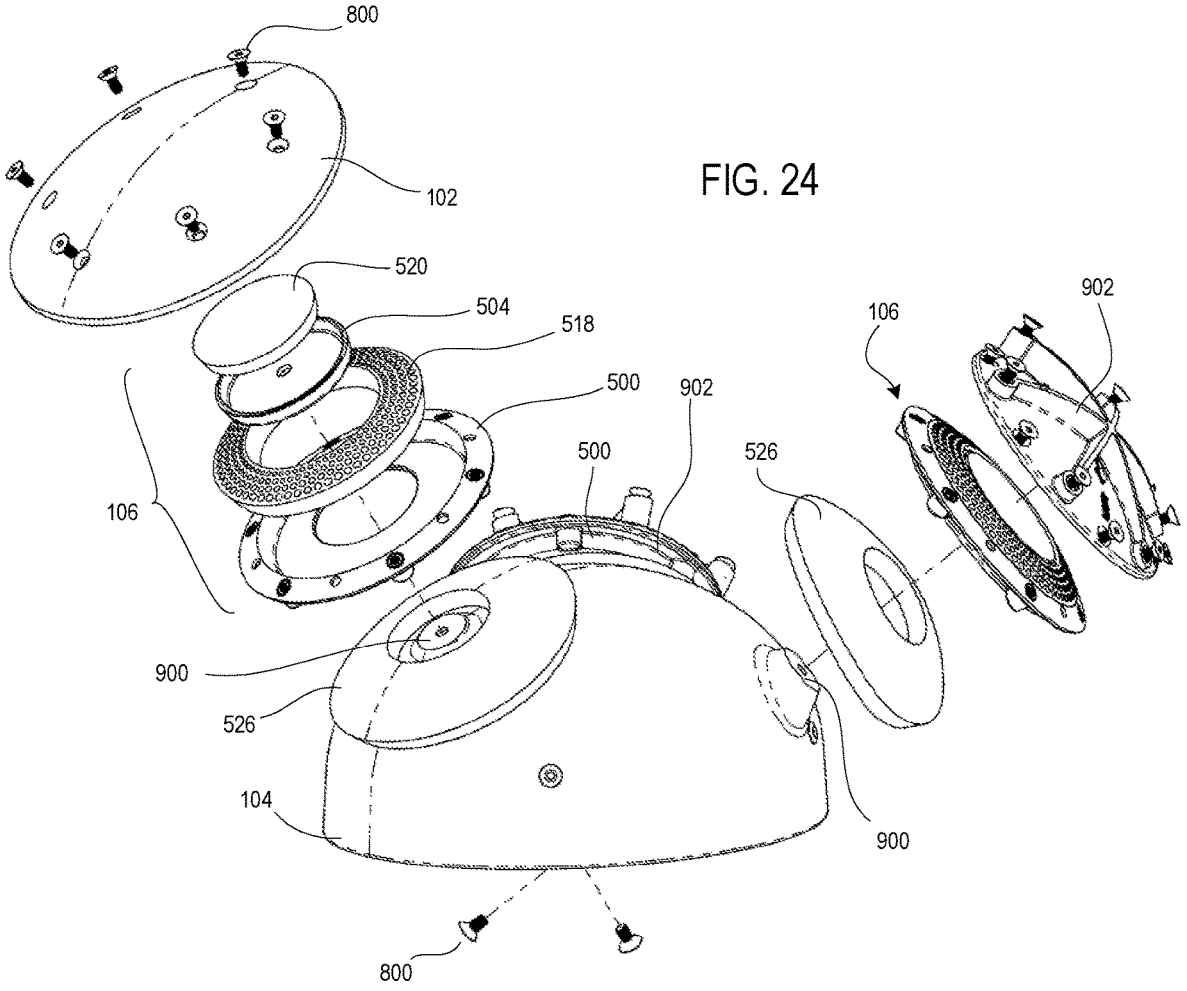
FIG. 24 is a partially exploded view illustrating multiple orbital connectors in various states of assembly with an inner helmet and an outer helmet.

FIG. 24 shows another example of a helmet system 100 in partial exploded view. In this case, the resilient barrier 518 has holes to reduce deflection resistance, such as described in relation to FIGS. 15 and 16. In addition, the resilient supports 526 are provided as relatively simple pads that may be attached directly to the inner helmet 104 by adhesives or the like.

Figure 25:
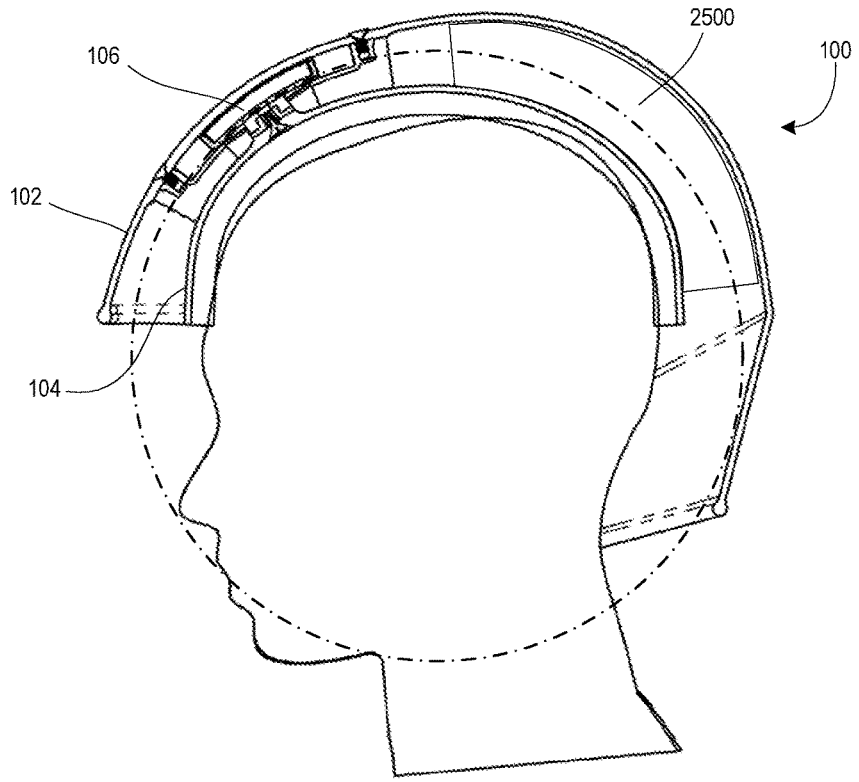
FIG. 25 is a cross-sectional side elevation view of another exemplary embodiment of a helmet system.

FIG. 25 shows additional alternative features, which may be used separately or together, or in combination with the other embodiments described herein. In this example, the helmet system 100 comprises an outer helmet 102 and inner helmet 104 that are connected by a single orbital connector 106. The orbital connector 106 preferably is located at a likely location for impacts. For example, in the shown embodiment, the orbital connector 106 is located at the anterior skull region between the forehead and the top of the head, where it is intended to mitigate impacts caused by falling forward. Such a configuration may be useful in bicycle helmets, skiing helmets, and other helmets intended for use in non-contact sports where impacts from the rear are less likely. As another example, the orbital connector 106 may be located on a lateral side of the skull region, as may be desirable to deflect impacts from oncoming objects such as baseballs and cricket balls. The helmet system 100 of FIG. 25 also incorporates conventional impact padding 2500 to hold the outer helmet 102 and inner helmet 104 in proper position. This example also has an outer helmet 102 that lacks a chin guard. Other alternatives and variations will be apparent to persons of ordinary skill in the art in view of the present disclosure.

As noted above, the helmet system 100 may include one or more strap assemblies, such as under-shin straps and chin straps, that are configured to hold the helmet system 100 to the wearer's head. FIGS. 26-29 show various alternative arrangements of strap assemblies.

Figure 26:
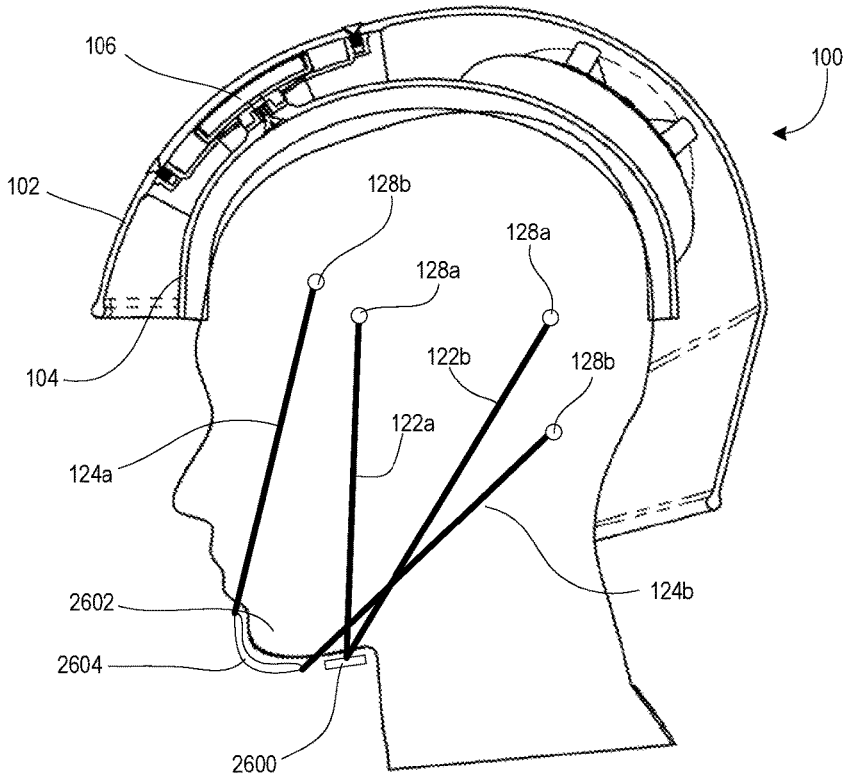
FIG. 26 is a cross-sectional side elevation view of another exemplary embodiment of a helmet system showing an alternative strap arrangement.

FIG. 26 shows a helmet system 100 having an under-chin strap 2600 that wraps around below the wearer's chin 2602, and a chin strap 2604 that wraps around the front of the wearer's chin 2602. The under-chin strap 2600 is connected, on each lateral side of the helmet system 100, to the inner helmet 104 via an inner strap assembly. The inner strap assembly includes a front inner strap 122*a* and a rear inner strap 122*b* on each side of the helmet system 100. The inner strap assembly is connected to the inner helmet 104 by a first set of connectors 128*a*. Similarly, the chin strap 2604 is connected, on each lateral side of the helmet system 100, to the outer helmet 102 via an outer strap assembly. The outer strap assembly includes a front outer strap 124*a* and a rear outer strap 124*b* on each side of the helmet system 100. The outer straps 124*a*, 124*b* are connected to the outer helmet 102 by a second set of connectors 128*b*. The strap assemblies may have any suitable construction, such as nylon webbing straps that are connected by sliding adjusters or snaps, openable clasps or hooks, and so on.

Figure 27:
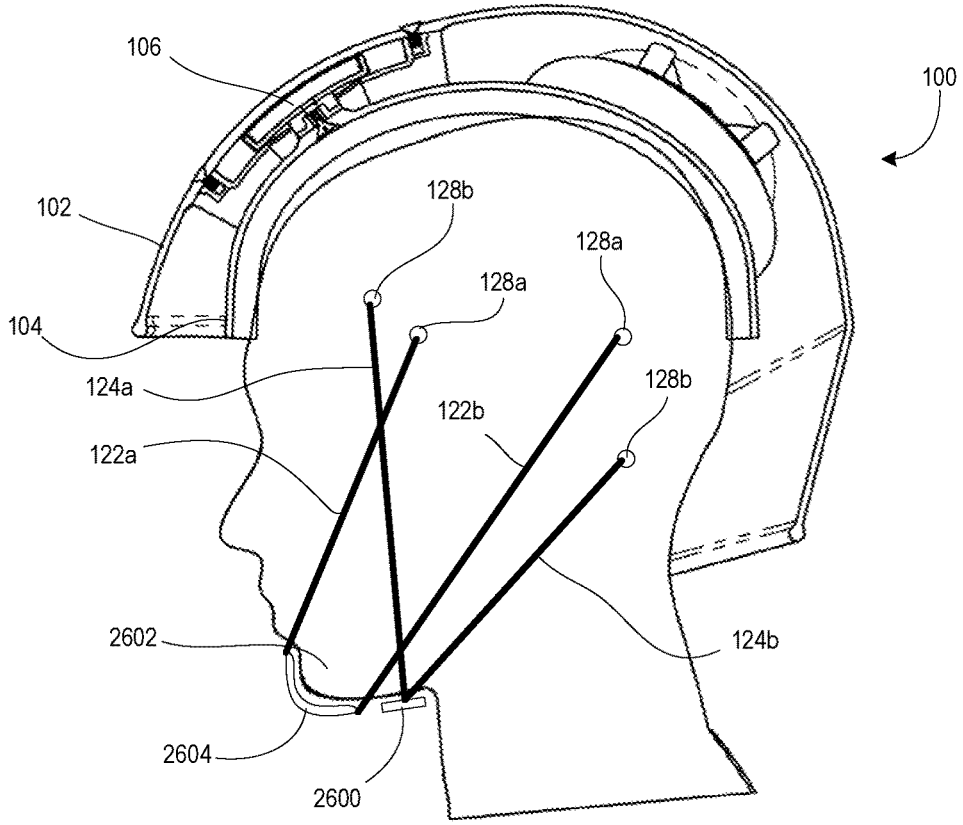
FIG. 27 is a cross-sectional side elevation view of another exemplary embodiment of a helmet system showing an alternative strap arrangement.

The embodiment of FIG. 27 is the same as the embodiment of FIG. 26, except that the under-chin strap 2600 is connected via the outer strap assembly to the outer helmet 102, and the chin strap 2604 is connected via the inner strap assembly to the inner helmet 104.

Figure 28:
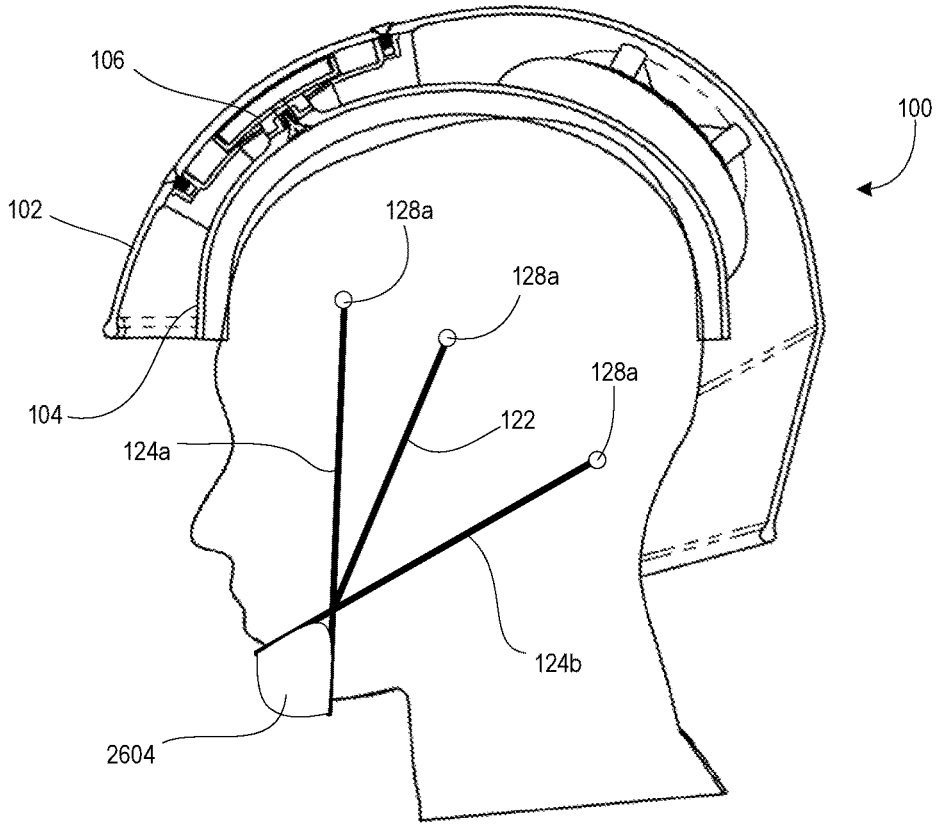
FIG. 28 is a cross-sectional side elevation view of another exemplary embodiment of a helmet system showing an alternative strap arrangement.
Figure 31:
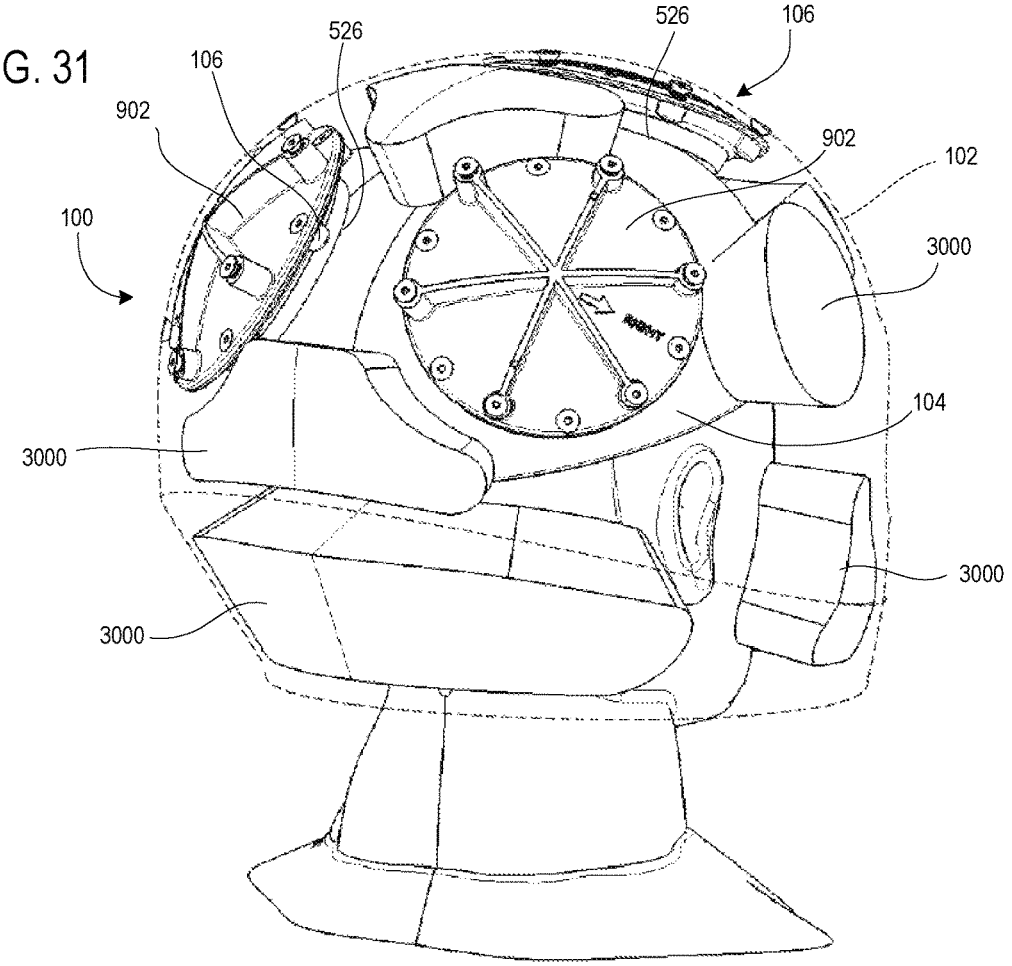
FIG. 31 is a rear isometric view of the helmet system of FIG. 30.
Figure 32:
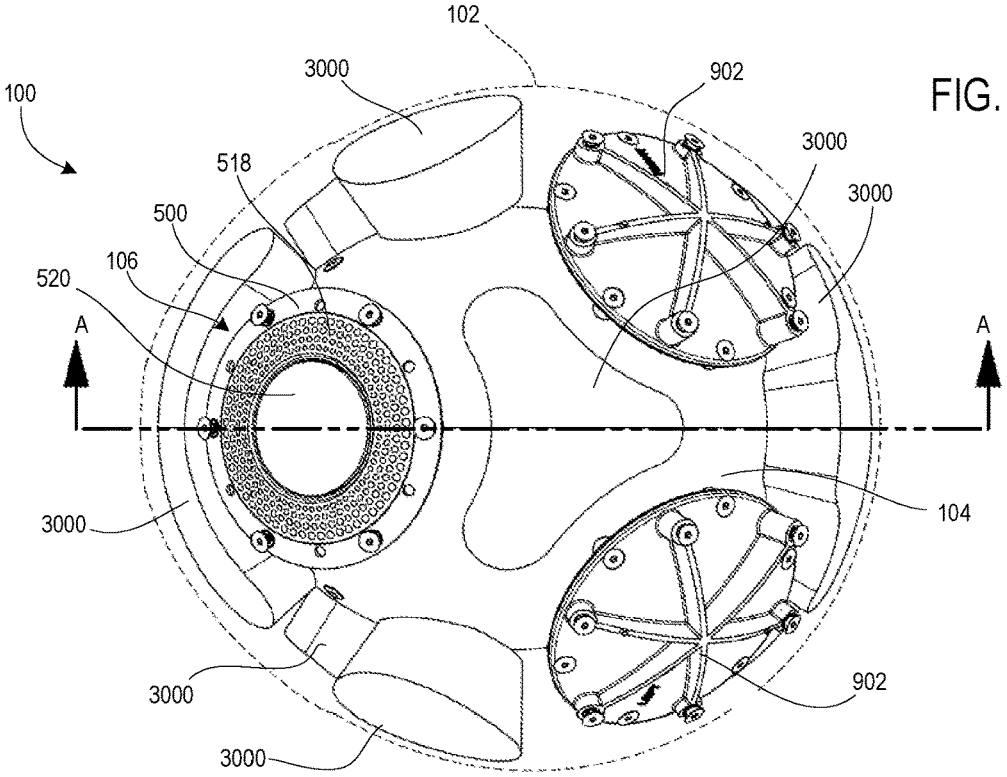
FIG. 32 is a top plan view of the helmet system of FIG. 30.
Figure 33:
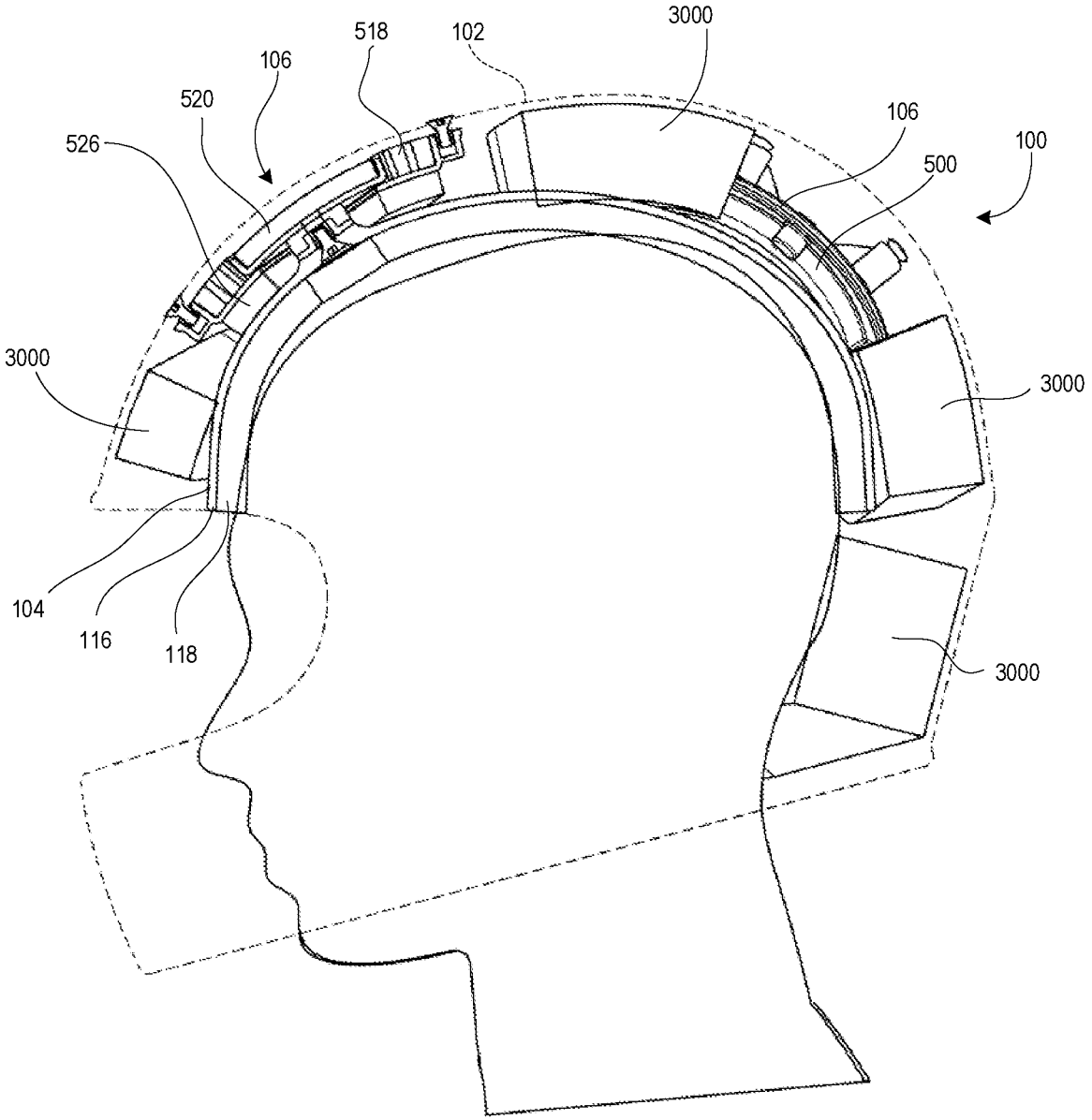
FIG. 33 is cross-sectional side elevation view of the helmet of FIG. 30, shown along line A-A in FIG. 32.

In FIG. 28, the helmet system 100 has chin strap 2604, but no under-chin strap 2600. In this example, the outer strap assembly and the inner strap assembly are all connected to the chin strap 2604. FIG. 28 also shows another alternative configuration, in which the inner strap assembly comprises a single inner strap 122 on each side of the helmet system 100.

FIG. 29 shows another exemplary embodiment of a helmet system 100. In this case, the inner strap assembly is formed as an under-chin strap having a bifurcated and Y-shaped inner strap 122 that joins a single strap under the chin, but splits on each side of the helmet system 100 to connect to the inner helmet 104 at two locations. This example also shows the outer strap assembly being attached to connectors 128 located on the outer surface of the outer helmet 102, to thereby allow rapid connection of the outer strap assembly.

In any of the foregoing examples, one of the inner strap assembly and the outer strap assembly may be omitted or replaced by a different strap system. It will also be appreciated that any strap forming a strap assembly may comprise a single webbing or band of material (e.g., the single inner strap 122 in FIG. 28), or it may comprise multiple webbings or bands, or webbings or bands that are bifurcated or otherwise divided into multiple components.

It will be understood that the various parts of the helmet system 100 and orbital connector 106 may be made from any suitable materials, such as plastic, metal, composites, elastomers, or the like. The selection of suitable materials will be possible to persons of ordinary skill in the art, without undue experimentation, upon practicing embodiments of the invention. Referring now to FIGS. 30 to 33, an example of a helmet system 100 configured for use in a contact sport, such as American Football, is described with a selection of exemplary materials and other properties that may be suitable in some embodiments.

The exemplary helmet system 100 of FIGS. 30 to 33 comprises an outer helmet 102 that is connected to an inner helmet 104 by three orbital connectors 106, such as those described herein. The outer helmet 102 comprises a shell of rigid material such as polycarbonate plastic, a composite formed by high-strength fibers (e.g., aramid) and a resin matrix, or the like. Each orbital connector 106 has a slip disc housing 500 mounted to the outer helmet 102, and a slip disc 504 mounted to the inner helmet 104. Each orbital connector 106 includes a resilient barrier 518 and a resilient pad 520, and a resilient support 526 is positioned between each orbital connector 106 and the inner helmet 104. The resilient supports 526 may be captured in place, adhered to the inner helmet 104, or adhered to the orbital spacer 106 (e.g., attached to the slip disc housing 500). The helmet system 100 also includes a plurality of inserts 3000 comprising impact-attenuating material to provide further impact absorption. The inserts 3000 may be connected to one or both of the outer helmet 102 and the inner helmet 104, but preferably are not connected in such a manner to inhibit the desired degree of movement of the orbital spacers 106. The inserts 3000 also preferably are not formed of a material that is rigid enough to impair the operation of the orbital spacers 106.

The resilient barrier 518, resilient pad 520, resilient support 526 and spacers 3000 may comprise any suitable impact attenuating material, such as synthetic or natural rubbers, polyurethanes, and the like. The material may be provided in block form, as an open-cell or closed-cell foam, as a high-density foam or low-density foam, or in any other suitable form. Exemplary materials include, but are not limited to: polyvinyl nitrile foam (PVN), Poly(vinyl formal) (PVF) foam, neoprene and neoprene blends, high-density polyurethane, expanded polystyrene and so on.

In one exemplary embodiment, the resilient barriers 518 are selected to allow at least about 0.5 inches of relative movement between the outer helmet and the inner helmet in a direction tangential to the spherical center SC defined by the orbital spacers 106. In another exemplary embodiment, the resilient barriers 518 may be configured to allow the slip disc 504 and slip disc housing 500 of each orbital spacer 106 to move at least about 0.5 inches relative to each other in a direction tangential to the spherical center SC defined by the orbital spacer 106. Other embodiments may allow different degrees of motion, and may be tailored to particular sports or activities, or to individual users.

The helmet system 100 may be assembled using any suitable method. In a preferred embodiment, the helmet system 100 is assembled by: (1) assembling each slip disc 504, post 510, resilient barrier 518 and slip disc housing 500 into an orbital connector 106; (2) attaching each orbital connector 106 to the inside of the outer helmet 102 using screws (e.g., six #8, 32 thread per inch screws) that pass through the outer helmet 102 and into the slip disc housing 500; and then (3) attaching the inner helmet 104 to each orbital connector 106 using screws (e.g., a single #10, 24 thread per inch screw) that pass through the inner helmet 104 and into the post 510. Other assembly methods may be used in other embodiments.

It will be understood that the various embodiments may be used in conjunction with each other in any operable combination. For example, the features unique to the embodiments of FIGS. 13A through 30 generally may be used with any other embodiment.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

What is claimed:

1. A helmet system comprising:

an outer helmet;

an inner helmet; and a first orbital connector joining the outer helmet to the inner helmet, the first orbital connector comprising:

a slip disc housing mounted on one of the outer helmet and the inner helmet, the slip disc housing having a first face and an opening through the first face, a slip disc comprising a second face abutting the first face, the second face being movable in sliding contact with the first face relative to a spherical center, and a post extending through the opening and mounting the slip disc to the other of the outer helmet and the inner helmet and, wherein the post is dimensioned to move within the opening to allow the second face to move tangentially to the spherical center in sliding contact with the first face.

2. The helmet system of claim 1, wherein the slip disc housing is mounted to the outer helmet and the slip disc is mounted to the inner helmet.

3. The helmet system of claim 1, wherein the first orbital connector further comprises:

a housing perimeter wall attached to and extending away from an outer perimeter of the first face;

a disc perimeter wall attached to the slip disc and extending away from the first face; and a resilient barrier positioned between the housing perimeter wall and the disc perimeter wall, at least a portion of the resilient barrier being deformable to allow the second face to move tangentially to the spherical center in sliding contact with the first face.

4. The helmet system of claim 1, wherein the first orbital connector further comprises a resilient pad extending from the slip disc to the one of the outer helmet and the inner helmet, the resilient pad being compressed to generate a restoring force against the slip disc and the one of the outer helmet and the inner helmet, wherein the restoring force generates a frictional force to frictionally hold the slip disc relative to the slip disc housing.

5. The helmet system of claim 4, wherein the first orbital connector further comprises a disc perimeter wall attached to the slip disc and extending away from the first face, and the resilient pad is contained, in a direction tangential to the spherical center, within the disc perimeter wall.

6. The helmet system of claim 1, wherein the first orbital connector further comprises a housing perimeter wall attached to and extending away from an outer perimeter of the first face, and a plurality of fastener interfaces surrounding the housing perimeter wall and facing away from the first face, the plurality of fastener interfaces each being configured to receive a respective fastener to rigidly connect the first face to the one of the outer helmet and the inner helmet.

7. The helmet system of claim 1, wherein the post further comprises a fastener interface facing away from the second face and configured to receive a fastener to rigidly connect the post to the other of the outer helmet and the inner helmet.

8. The helmet system of claim 1, wherein the first orbital connector further comprises a resilient support positioned between the slip disc housing and the other of the outer helmet and the inner helmet.

9. The helmet system of claim 1, wherein the resilient support comprises a support opening surrounding the post, wherein the post is dimensioned to move within the support opening to allow the second face to move tangentially to the spherical center in sliding contact with the first face.

10. The helmet system of claim 1, wherein the outer helmet comprises:

a main body configured to surround a wearer's superior and posterior skull regions;

an anterior opening configured to be adjacent the wearer's eyes; and a chin guard extending from the main body and below the anterior opening and configured to surround the wearer's chin.

11. The helmet system of claim 1, wherein the inner helmet comprises:

an outer shell; and a foam layer located inside the outer shell;

wherein the foam layer is configured to be more flexible than the outer shell.

12. The helmet system of claim 1, further comprising:

an inner strap assembly comprising a first inner strap attached to a first lateral side of the inner helmet, and a second inner strap attached to a second lateral side of the inner helmet; and an outer strap assembly comprising a first outer strap attached to the first lateral side of the outer helmet, and a second outer strap attached to the second lateral side of the outer helmet.

13. The helmet system of claim 12, wherein the first inner strap and the second inner strap are configured to be connected to each other at a location below the wearer's chin, and the first outer strap and the second outer strap are configured to be connected to each other at a location surrounding a front of the wearer's chin.

14. The helmet system of claim 12, wherein the first inner strap and the second inner strap are configured to be connected to each other at a location surrounding a front of the wearer's chin, and the first outer strap and the second outer strap are configured to be connected to each other at a location below the wearer's chin.

15. The helmet system of claim 1, further comprising one or more additional orbital connectors joining the outer helmet to the inner helmet, each of the one or more additional orbital connectors comprising:

a respective slip disc housing mounted on one of the outer helmet and the inner helmet and comprising a respective first face and a respective opening through the respective first face; and a respective slip disc mounted on the other of the outer helmet and the inner helmet and comprising a respective second face abutting the respective first face and movable in sliding contact with the respective first face relative to a respective spherical center, and a respective post extending through the respective opening, wherein the respective post is dimensioned to move within the respective opening to allow the respective second face to move tangentially to the respective spherical center in sliding contact with the respective first face;

wherein the respective spherical center of the first orbital connector and the respective spherical center of each of the one or more additional orbital connectors are spherically concentric.

16. The helmet system of claim 15, wherein the one or more additional orbital connectors comprise two additional orbital connectors.

17. The helmet system of claim 16, wherein the first orbital connector is located at a medial, anterior position relative to the inner helmet and the outer helmet and the two additional orbital connectors are located at posterior and opposite lateral positions relative to the inner helmet and the outer helmet.

18. An orbital connector for a helmet system, the orbital connector comprising:

a slip disc housing configured to be mounted on a first helmet surface and comprising a first face and an opening through the first face;

a slip disc comprising a second face abutting the first face, the second face being movable in sliding contact with the first face relative to a spherical center; and a post extending through the opening and configured to mount the slip disc to a second helmet surface;

wherein the post is dimensioned to move within the opening to allow the second face to move tangentially to the spherical center in sliding contact with the first face.

* * * * *